US006142121A

United States Patent [19]

Nishimura et al.

[11] Patent Number: 6,142,121

[45] Date of Patent: Nov. 7, 2000

[54] METHOD AND DEVICE FOR FUEL INJECTION OF ENGINE

[75] Inventors: Terukazu Nishimura; Tsutomu Fuseya; Shigehisa Takase, all of Kanagawa, Japan

[73] Assignee: Isuzu Motors Limited, Tokyo, Japan

[21] Appl. No.: 09/155,573

[22] PCT Filed: Feb. 6, 1998

[86] PCT No.: PCT/JP98/00507

§ 371 Date: Oct. 1, 1998

§ 102(e) Date: Oct. 1, 1998

[87] PCT Pub. No.: WO98/35150

PCT Pub. Date: Aug. 13, 1998

[30] Foreign Application Priority Data

Feb. 7, 1997 [JP] Japan ..... 9-038544

[51] Int. Cl.[7] ..... F02M 41/00; F02M 7/00

[52] U.S. Cl. ..... 123/456; 123/447

[58] Field of Search ..... 123/447, 456, 123/467

[56] References Cited

U.S. PATENT DOCUMENTS

| | | | |
|---|---|---|---|
| 5,201,294 | 4/1993 | Osuka | 123/458 |
| 5,241,933 | 9/1993 | Morikawa | 123/198 D |
| 5,577,479 | 11/1996 | Popp | 123/458 |
| 5,598,817 | 2/1997 | Igarashi et al. | 123/179 |
| 5,816,220 | 10/1998 | Stumpp et al. | 123/435 |

FOREIGN PATENT DOCUMENTS

| | | |
|---|---|---|
| 62-182460 | 8/1987 | Japan . |
| 62-186034 | 8/1987 | Japan . |
| 02291447 | 12/1990 | Japan . |
| 5-125985 | 5/1993 | Japan . |
| 6-093915 | 4/1994 | Japan . |

*Primary Examiner*—Henry C. Yuen
*Assistant Examiner*—Mahmoud M Gimie
*Attorney, Agent, or Firm*—Browdy and Neimark

[57] ABSTRACT

In the fuel injection method and device for engines, information obtained from the differential value of the common rail pressure is used to correct the parameters of the command pulses to the flow control valve and the solenoid valve of each injector and thereby limit deviations of the fuel injection characteristic of the injector from the target injection characteristic. From the curves of the differential values R of the common rail pressure Pc, the actual fuel injection parameters for the injectors-injection start timing Tis, gross injection amount Qt, initial injection amount Qe and maximum injection rate Rmax-are obtained. The command pulse output timing (PTpf, PTif) for the flow control valve, which controls the amount of fuel delivered from the fuel pump, and for the solenoid valve of each injector and the gross or initial command pulse width (PWit, PWief) for the solenoid valves of each injector are controlled so that the above parameters agree with the target injection characteristic determined from the corresponding operating states of the engine.

18 Claims, 13 Drawing Sheets

< Routine for setting final target gross command pulse width PWitf for solenoid valve >

< Routine for setting final target initial command pulse width PWief for solenoid valve >

< Routine for calculating feedback correction amount >

( Feedback correction amount PTic routine 510 )

( Feedback correction amount PWitc routine 520 )

( Feedback correction amount PWiec routine 530 )

( Feedback correction amount PTpc routine 540 )

METHOD AND DEVICE FOR FUEL INJECTION OF ENGINE

FIELD OF THE INVENTION

The present invention relates to a fuel injection method and device for engines to inject fuel stored in a common rail through injectors.

BACKGROUND ART

Regarding the fuel injection control in engines, a common-rail type fuel injection system has been known which provides a high injection pressure and performs optimum control on injection conditions, such as fuel injection timing and the amount of fuel injected, according to the operating condition of the engine. The common rail type fuel injection system is a system that stores in the common rail a fuel pressurized to a predetermined pressure by a fuel pump and then injects the stored high-pressure fuel into corresponding combustion chambers from injectors under the control of a controller. Fuel flow paths extending from the common rail through branch pipes to nozzle holes of individual injectors are acted upon at all times by a fuel pressure corresponding to the injection pressure. The controller controls the individual injectors so that the pressurized fuel is injected from each injector under an optimum injection condition according to the operating state of the engine.

An outline of the common-rail type fuel injection system is shown in FIG. 12. In the common-rail type fuel injection system, the fuel is supplied from the common rail 2 through branch pipes 3 forming a part of the fuel flow paths to injectors 1 that inject fuel into corresponding combustion chambers. The fuel, which was pumped by a feed pump 6 from a fuel tank 4 through a filter 5, is delivered through a fuel pipe 7 to a fuel pump 8 which, for example, is a variable-displacement high-pressure pump of plunger type. The fuel pump 8 is driven by the engine to raise the pressure of the fuel to a required predetermined pressure and supply the fuel to the common rail 2 through a fuel pipe 9. The fuel pump 8 maintains the fuel pressure in the common rail 2 at a predetermined pressure. The fuel released from the fuel pump 8 is returned to the fuel tank 4 through a return pipe 10. Of the fuel supplied from the branch pipes 3 to the injectors 1, the fuel that was not used for injection into the combustion chambers is returned to the fuel tank 4 through a return pipe 11.

The controller 12 as an electronic control unit is supplied with signals from various sensors for detecting the engine operating condition, which include an engine revolution speed sensor 40 to detect an engine revolution speed Ne, an engine cylinder determination sensor 41, a top dead center (TDC) detection sensor 42, an accelerator pedal depression amount sensor 43 to detect the amount of accelerator pedal depression Acc, a cooling water temperature sensor 44 to detect the temperature of cooling water Tw, an atmospheric temperature sensor 45 to detect the temperature of atmosphere Ta, an atmospheric pressure sensor 46 to detect the pressure of atmosphere Pa, and an intake pipe inner pressure sensor 47 to detect the inner pressure of the intake pipe Pb. The controller 12, based on these signals, controls the fuel injection conditions of the injectors 1, i.e., the fuel injection timing and the amount of fuel to be injected, so that the engine output will become optimum for the engine operating condition. The common rail 2 is provided with a pressure sensor 13 which detects a fuel pressure Pc in the common rail 2 and sends the detection signal to the controller 12. The fuel pressure in the common rail falls when the fuel in the common rail 2 is consumed by the injectors 1 injecting the fuel. The controller 12 controls the amount of fuel delivery from the fuel pump 8 so that the fuel pressure in the common rail 2 remains constant.

FIG. 13 shows a cross section of the injector 1. The injector 1 is mounted hermetically, through a seal member, in a hole portion provided in a base such as cylinder head. The structure of the cylinder head is not shown. The side portion of an upper part of the injector 1 is connected with a branch pipe 3 through a fuel inlet joint 20. The injector 1 has fuel passages 21, 22 formed therein, and the branch pipe 3 and the fuel passages 21, 22 together form fuel flow paths. The fuel supplied from the fuel flow paths flows past a fuel sump 23 and a passage around a needle valve 24 and is injected into the combustion chamber from nozzle holes 25 that are opened when the needle valve 24 is lifted.

The injector 1 is provided with a balance chamber type needle valve lift mechanism that controls the lift of the needle valve 24. That is, at the uppermost part of the injector 1 is provided a solenoid valve 26 whose solenoid 28 is supplied with a control current as a control signal from the controller 12 through a signal line 27. When the solenoid 28 is energized, an armature 29 is lifted to open an on-off valve 32 provided at the end of a fuel passage 31, through which the fuel pressure supplied to a balance chamber 30 is released. The injector 1 has a hollow space 33 formed therein, in which a control piston 34 is installed vertically movable. Because a push-down force acting on the control piston 34 which is a combined force of the reduced inner pressure in the balance chamber 30 and the spring force of a return spring 35 is exceeded by a push-up force acting on the control piston 34 which is produced by the fuel pressure acting on a tapered surface 36 facing the fuel sump 23, the control piston 34 moves up. As a result, the needle valve 24 is lifted injecting fuel from the nozzle holes 25. The amount of fuel injected is determined by the fuel pressure in the fuel flow paths and the lift (the amount and duration of the lift) of the needle valve 24. The lift of the needle valve 24 is determined by an injection pulse as a control current sent to the solenoid 28 which controls the on-off operation of the on-off valve 32.

FIG. 14 shows the relation between the amount Q of fuel injected from the injector 1 and the width W of a command pulse supplied from the controller 12 to the solenoid 28, with the fuel pressure Pc (fuel pressure in the common rail 2) as a parameter. If the fuel pressure Pc is taken to be constant, the fuel injection amount Q increases with the command pulse width W. For the same command pulse width W, the fuel injection amount Q increases as the fuel pressure Pc increases. The fuel injection starts or stops with a certain time delay after the command pulse has risen or fallen. Thus, controlling the timing at which the command pulse is turned on or off enables the injection timing to be controlled.

The amount of fuel to be injected in each combustion cycle is calculated from a basic injection amount characteristic map shown in FIG. 15. FIG. 15 shows how a basic injection amount Qtb changes according to the engine revolution speed Ne with the abscissa representing the engine revolution speed Ne and the ordinate representing the basic injection amount Qtb and with the accelerator pedal depression amount Acc taken as a parameter changing to various values. As shown in FIG. 15, the characteristic map is so set that when, with the accelerator pedal depression amount Acc kept constant, the engine revolution speed Ne increases, the basic injection amount Qtb decreases. Hence, when the engine revolution speed Ne increases for some reason, the feedback control reduces the amount of fuel to be injected according to the basic injection amount Qtb, causing the engine revolution speed Ne to be reduced. As a result, the engine revolution speed will stabilize at a fuel injection amount that balances with the internal resistance of the engine.

In the fuel injection control device for engines, the following proposals have been made as measures to control the fuel injection timing and amount with high precision. That is, in a system where the fuel injection is controlled based on a reference timing and an injection period from the reference timing, it is proposed that a dummy injection device be provided separate from the engine cylinders and that the actual injection amount from the dummy injection device be detected and used to determine the amount of fuel to be injected in order to prevent the fuel injection amount from being changed greatly by small variations of the engine revolution speed (see Japanese Patent Laid-Open No. 182460/1987).

A high-pressure fuel delivery under pressure by the fuel supply pump, a pressure reduction at times of injection, and a water hammer action from valve closure at the end of injection cause pulsations in the common rail pressure. It is known from experience that even during the pulsations the common rail pressure at the trailing edge of the command pulse for the fuel injection valve is almost equal to the actual injection pressure. Taking advantage of this fact, it has been proposed that the common rail pressure at the trailing edge of the command pulse be sampled to determine the amount of fuel to be injected (see Japanese Patent Laid-Open No. 125985/1993).

Further, in a common-rail type fuel injection control device which, based on the detected value of the operating condition parameter such as engine revolution speed and accelerator pedal opening and the detected value of the injection pressure in a cylinder that has finished injection in a previous cycle, calculates an injection pressure command value for the cylinder to be used in the next injection cycle and performs fuel injection for an injection period corresponding to this injection pressure command value; it is proposed that when the engine is in a transient state, an instantaneous change in the fuel injection pressure corresponding to a crank angle be calculated to correct the injection pressure for the cylinder used to determine the fuel injection period that will be used in the next injection cycle, thereby improving the precision of the fuel injection control during the transient state (see Japanese Patent Laid-Open No. 93915/1994).

These common-rail type fuel injection control devices described in the above official gazettes attempt to improve the precision of the fuel injection from a variety of standpoints but do not consider variations of fuel injection among cylinders. That is, in the common-rail type fuel injection systems, the rate of fuel injected from the injectors depend on the common rail pressure, nozzle hole diameter, the speed at which the needle valve is opened, and the throttle of the fuel flow paths. The common rail pressure is common to all injectors while other factors including the nozzle hole diameter, the needle valve's opening speed and the throttle of the fuel flow paths differ from one injector to another. Thus, even when the operating states of the solenoid valves used for the control of the lift of the needle valves in the injectors are made equal, inevitable variations in the fuel injection rate characteristics such as the fuel injection start timing, the fuel injection rate and the maximum fuel injection pressure render uniform control among the cylinders difficult.

As for the variations in fuel injection among the injectors, detailed descriptions will be given with reference to FIG. 16 that illustrates changes over time of the fuel injection rate. The graph of FIG. 16 shows the fuel injection rate when the energization times of the solenoid valves of the injectors in a 6-cylinder engine are made equal. The figure shows the fuel injection rates of two injectors between which a largest injection rate difference exists, and also an average fuel injection rate of the six injectors. There are the following three factors that can cause variations in the fuel injection rate among the injectors. As to the fuel injection start timing, there is a variation of about 1.5 degrees in crank angle CA as shown at A in the figure; regarding the amount of fuel injected during the initial injection period (ignition delay period) tf, there is a relative variation of about 30% as shown at B; and as to the maximum injection rate, there is a relative variation of about 15% as shown at C.

When a single engine has such variations in the fuel injection characteristics among the injectors installed in the corresponding cylinders, it is impossible to obtain optimum injection timing and fuel injection amount for each injector, which in turn degrades the cleanliness of the exhaust gas and causes combustion imbalance among the cylinders, resulting in noise and vibrations.

The variations in the fuel injection characteristics are considered to be caused by variations in the machining and assembly precision including dimensional and coarseness precision during the course of manufacture of the constitutional parts, such as injector nozzle hole diameters, needle valve opening speed and fuel flow path throttle. These variations are unique to each injector, and to reduce them uniformly among the injectors requires further improvement of the machining and assembly precision of the injector components. Improving these precisions, however, gives rise to another problem of increased manufacturing cost because it requires modifying production facilities.

If, when injectors have injection characteristics variations among them, the injection characteristics can be corrected in a way that reduces injection characteristics variations among the injectors, it should be possible to perform control so that the injection characteristics are uniform among all of the injectors, without having to take a drastic measure of changing the production facilities—a factor that contributes to increased cost—to make further improvements in the machining and assembly precision of the injector components.

An object of this invention is to solve the above-described problems and to provide a fuel injection control method and device which, by taking advantage of the fact that the fuel injection of each injector is electronically controlled, eliminates variations in the injection characteristics among the injectors based on data obtained by time-differentiating the common rail pressure and thereby controls the injection timing and the amount of fuel to be injected so that the injection characteristics of all of the injectors used will be uniform.

If, of variations in the fuel injection characteristics, the fuel injection start timing variations in terms of crank angle CA can be limited to within 0.2 degrees, the fuel injection amount variations during the ignition delay period can be limited to within ±5%, and the maximum injection rate variations can be limited to within ±2%, the uniformity of combustion among the cylinders can be maintained. This prevents deterioration of cleanliness of exhaust gas and maintains the combustion balance among the cylinders, which in turn keeps noise and vibrations from deteriorating.

DISCLOSURE OF THE INVENTION

The present invention relates to a fuel injection method for engines, in which fuel delivered by a fuel pump is stored in a common rail, in which the fuel supplied from the common rail through fuel flow paths is injected from nozzle holes formed in injectors into combustion chambers of an engine, in which an operating state of the engine is detected by sensors, and in which a controller sets a target injection characteristic based on detection signals from the sensors, sets a basic target control amount corresponding to the target injection characteristic to execute the fuel injection from the injectors and controls an injection characteristic of the injectors based on the basic target control amount. More particularly, this invention relates to the fuel injection method of a type described above which is characterized by comprising the steps of: determining the injection characteristic based on a differential, or a rate of change over time, of the fuel pressure in the common rail following the fuel injection; to eliminate variations of the injection characteristic of each of the injectors, setting a final target control amount which was obtained by correcting the basic target control amount based on the target injection characteristic and the injection characteristic; and controlling the injection characteristic of the injectors based on the final target control amount.

With the fuel injection method for engines of this invention having the above-described configuration, the fuel injection from the injectors is controlled as follows. The injection characteristic of each of the injectors is determined based on the differential, or a rate of change over time, of the fuel pressure in the common rail following the fuel injection. That is, by detecting the change over time of the fuel pressure in the common rail, information on the injectors' injection characteristic can be obtained. The controller sets the target injection characteristic based on detection signals from the sensors, and also sets the basic target control amount corresponding to the target injection characteristic to execute the fuel injection from the injectors. Comparison between the target injection characteristic and the injection characteristic obtained from the differentiation of the common rail fuel pressure enables us to identify how far the injection characteristic is deviated from the target injection characteristic, i.e., variations of the injection characteristic of individual injectors. A final target control amount is set by correcting the basic target control amount for the fuel injection of each injector according to information obtained from the above comparison. Based on this final target control amount, the injection characteristic of the injector is modified.

The main parameters that determine the injectors' injection characteristic are an injection timing representing the time at which to start the fuel injection, in other words, a fuel injection start timing; a gross injection amount of fuel injected at each injection which affects the output of the engine; an initial injection amount during an initial injection period (ignition delay period) which has a great influence on the main combustion; and a maximum injection rate that relates the gross injection amount to the injection period. Hence the injection characteristic in the above fuel injection method for engines includes at least the following quantities. First, the maximum injection rate is determined as a quantity corresponding to the maximum value of the differential of the fuel pressure. Without a positive or negative sign of the differential taken into account, the maximum value of the differential of the fuel pressure represents a maximum fall of the fuel pressure. When the fuel pressure fall is maximum, this means that a maximum amount of fuel per unit time is flowing out from the common rail, and therefore that the maximum value of the differential of the fuel pressure corresponds to a maximum injection rate. The injection start timing is determined as a time when the differential of the fuel pressure exceeds a predetermined value. The fuel pressure fall becoming greater than a certain value means that the fuel has started to flow out from the common rail. Further, the gross injection amount is determined as a quantity corresponding to an integrated value obtained by integrating the differential of the fuel pressure over the fuel injection period. The fuel pressure differential represents the rate of fall of the fuel pressure per unit time as described above, in other words, the rate of flow of the fuel out of the common rail or the fuel injection rate. Hence, its integration corresponds to the amount of fuel injected. Further, the initial injection amount is determined as a quantity corresponding to an integrated value obtained by integrating the differential of the fuel pressure over the initial injection period. The target injection characteristic on the other hand includes at least a target maximum injection rate of the fuel, a target injection start timing, and a target gross injection amount or a target initial injection amount. With these quantities it is possible to determine an important injection characteristic greatly affecting the engine characteristics.

In the above fuel injection method for engines, the differential of the fuel pressure in the common rail is constantly changing and does not exhibit a smooth change. Hence, controlling the injection characteristic based on a particular differential representing a large instantaneous change may make it difficult to provide an intended control for limiting variations. For this reason, the injection characteristic is determined as a characteristic curve of differentials smoothed out over time, for example, as a moving average over a predetermined time period.

Further, in the above fuel injection method for engines, the injection characteristic is a maximum injection rate; the basic target control amount is a basic target command pulse output timing, calculated according to the target maximum injection rate, for the basic target command pulse to be output to the flow control valve provided in the fuel flow paths connecting the fuel pump and the common rail; and the final target control amount is a final target command pulse output timing which was obtained by correcting the basic target command pulse output timing so that the maximum injection rate is equal to the target maximum injection rate.

The common rail pressure is changing as described above and the maximum injection rate generally depends on the level of the fuel pressure in the common rail (hereinafter referred to as a common rail pressure). Because the common rail pressure is determined by the amount of fuel delivered by the fuel pump, it is possible to control the common rail pressure by dividing the fuel delivery period (which corresponds to a plunger stroke when, for example, the fuel pump is a plunger type fuel pump) into a period of fuel delivery to the common rail and a period of fuel leakage to the fuel tank. That is, a target maximum injection rate is set by a means such as a map already prepared from the injection amount to be injected in the current injection cycle and the engine revolution speed. Based on the maximum injection rate a target common rail pressure is set. The difference between the set target common rail pressure and the current common rail pressure is used to set the operation timing of the flow control valve, i.e., a basic target command pulse output timing. Although there are variations in operation among individual flow control valves, a maximum value of the differential of the common rail pressure corresponds to the actual maximum injection rate. Hence, based on comparison between the actual maximum injection rate and the target maximum injection rate, the basic target command pulse output timing for the flow control valve is corrected to set a final target command pulse output timing to control the flow control valve or the common rail pressure so that the actual maximum injection rate will coincide with the target maximum injection rate.

Further, in the above fuel injection method for engines, the injection characteristic is the injection start timing, the basic target control amount is a basic target command pulse output timing which is calculated, according to the target injection start timing of each injector, for a basic target command pulse to be output to a solenoid valve provided in each of the injectors to control the opening and closing of the nozzle holes, and the final target control amount is a final target command pulse output timing which is obtained by correcting the basic target command pulse output timing so that the injection start timing agrees with the target injection start timing.

As to the timing to start fuel injection by the injectors, even if the time when the current (command pulse) for energizing the solenoid of the solenoid valve of each injector was supplied is known, the response delay, including the behavior of solenoid, armature, on-off valve for releasing pressure from the balance chamber and needle valve, differs from one injector to another. However, because the timing at which the common rail pressure starts falling represents the actual injection start timing regardless of the presence or absence of the above response variations, it is possible to know at all times the actual injection start timing corresponding to the target injection start timing. The solenoid valve provided in each injector to control the opening and closing of the nozzle holes is supplied with a basic target command pulse for valve opening. The basic target command pulse output timing is calculated according to the target injection start timing of each injector. The basic target command pulse output timings are corrected one after another based on the comparison between the target injection start timing and the actual injection start timing to set a final target command pulse output timing. Based on this final target command pulse output timing, the solenoid valve is controlled so that the actual injection start timing will match the target injection start timing. The common rail pressure having stopped falling means that the fuel injection has stopped. Hence, the time at which the stopping of the fall of the common rail pressure is detected represents the injection end timing. A time period between the injection start timing and the injection end timing is the injection period.

Further, in the above injection method for engines, the injection characteristic is a gross injection amount, the basic target control amount is a basic target gross command pulse width which is calculated, according to the target gross injection amount, for a basic target command pulse to be output to a solenoid valve provided in each of the injectors to control the opening and closing of the nozzle holes, and the final target control amount is a final target gross command pulse width which is obtained by correcting the basic target gross command pulse width so that the gross injection amount will match the target gross injection amount.

Further, in the above injection method for engines, the injection characteristic is an initial injection amount, the basic target control amount is a basic target initial command pulse width which is calculated, according to the target initial injection amount corresponding to the target gross injection amount, for a basic target initial command pulse to be output to a solenoid valve provided in each injector to control the opening and closing of the nozzle holes, and the final target control amount is a final target initial command pulse width which is obtained by correcting the basic target initial command pulse width so that the initial injection amount is equal to the target initial injection amount.

As to the gross injection amount and the initial injection amount, even if the times when the current (command pulse) for energizing the solenoid of the solenoid valve of each injector was supplied and stopped are known, the response delay and response speed, including the behaviors of solenoid, armature, on-off valve for releasing pressure from the balance chamber and needle valve, differ from one injector to another. If the differential of the common rail pressure is integrated over the corresponding injection period as described above, the integrated value corresponds to an injection amount. Because the initial injection period can be deemed as a fixed period predetermined for the engine, integrating the differential of the common rail pressure over this period will result in a quantity corresponding to the initial injection amount. Thus, regardless of the presence or absence of variations in the injector characteristic, quantities equivalent to the actual gross injection amount and the initial injection amount can be detected at all times.

The solenoid valve provided in each injector to control the opening and closing of the nozzle holes is supplied with a basic target command pulse for valve opening. A basic target gross command pulse width is calculated based on the target gross injection amount which was determined from a map according to the engine operating state as detected by sensors. The basic target gross command pulse widths are corrected one after another based on comparison between the target gross injection amount and the actual gross injection amount calculated from the differential of the common rail pressure to set a final target gross command pulse width. Based on this final target gross command pulse width, the solenoid valve is controlled so that the actual gross injection amount will agree with the target gross injection amount.

The solenoid valve provided in each injector to control the opening and closing of nozzle holes is supplied with a basic target initial command pulse to execute the initial injection. A basic target initial command pulse width is calculated according to the target gross injection amount which was determined from a map according to the engine operating state detected by the sensors. The basic target initial command pulse widths are corrected one after another based on comparison between the target initial injection amount and the actual initial injection amount calculated from the differential of the common rail pressure to set a final target initial command pulse width. Based on this final target initial command pulse width, the solenoid valve is controlled so that the actual initial injection amount will match the target initial injection amount.

Further, in the above fuel injection method for engines provided with cylinders, the correction of the basic target control amount for each of the injectors provided in the cylinders of the engine is performed based on the injection characteristic of the associated injector which was determined at the previous fuel injection.

The present invention relates to a fuel injection device for engines, which is characterized by comprising: a common rail for storing fuel delivered by a fuel pump; injectors for injecting from nozzle holes into combustion chambers of the engine the fuel supplied from the common rail through fuel flow paths; sensors for detecting an operating state of the engine; and a controller for setting a target injection characteristic according to detection signals from the sensors and for setting a basic target control amount corresponding to the target injection characteristic to execute the fuel injection by each of the injectors; wherein the controller determines the injection characteristic for each of the injectors according to a differential, or a rate of change over time, of a fuel pressure in the common rail following the fuel injection, sets a final target control amount which was obtained by correcting the basic target control amount according to the target injection characteristic and the injection characteristic to eliminate variations of the injection characteristic of each injector, and controls the injection characteristic of each injector according to the final target control amount.

This fuel injection device for engines sets the target injection characteristic according to detection signals from the sensors representing the operating state of the engines and also sets the basic target control amount corresponding to the target injection characteristic to execute the fuel injection through the associate injector. The injector's injection characteristic is determined based on the differential, or the rate of change over time, of the fuel pressure in the common rail following the fuel injection. If the injection characteristic does not agree with the target injection characteristic due to variations of the fuel injection device including the injectors, the basic target control amount for the fuel injection from each injector is corrected based on the comparison between the target injection characteristic and the injection characteristic to set a final target control amount. Based on this final target control amount, the injection characteristic of the injector is controlled so that the injection characteristic will coincide with the target injection characteristic.

Further in the above fuel injection device for engines, the fuel pump is connected to the common rail through a flow control valve. The flow control valve controls the amount of fuel delivered to the common rail in response to the control signal received from the controller. The flow control valve, based on the control signal from the controller, controls the period of fuel delivery from the fuel pump and therefore the common rail pressure. In the fuel injection device for engines having the flow control valve, the injection characteristic is a maximum injection rate, the target injection characteristic is a target maximum injection rate, the basic target control amount is a basic target command pulse output timing for the flow control valve, and the final target control amount is a final target command pulse output timing for the flow control valve which was obtained by correcting the basic target command pulse output timing according to the maximum injection rate and the target maximum injection rate. Because the command pulse output timing for the flow control valve is corrected based on the maximum injection rate and the target maximum injection rate, the amount of fuel delivered from the fuel pump to the common rail is controlled. This in turn controls the common rail pressure, i.e., the pressure at which the fuel is injected from the injector, to eliminate variations of the maximum injection rate from the target maximum injection rate.

Further, in the above fuel injection device for engines, the injectors each have a solenoid valve that controls the opening and closing of the nozzle holes in response to the control signal from the controller. By controlling the opening and closing timings of and the opening and closing periods of the solenoid valve, the fuel injection timing and the injection amount from the nozzle holes of the injector can be controlled.

In the fuel injection device for engines in which the injectors each have a solenoid valve, the injection characteristic is an injection start timing, the target injection characteristic is a target injection start timing, the basic target control amount is a basic target command pulse output timing for each of the solenoid valves, and the final target control amount is a final target command pulse output timing for each of the solenoid valves which was obtained by correcting the basic target command pulse output timing according to the injection start timing and the target injection start timing. Because the command pulse output timing for the solenoid valve is corrected based on the injection start timing and the target injection start timing, the solenoid valve opening timing is controlled so that the injection start timing will agree with the target injection start timing, thereby limiting variations of the injection start timing from the target injection start timing.

In the fuel injection device for engines in which injectors each have a solenoid valve, the injection characteristic is a gross injection amount, the target injection characteristic is a target gross injection amount, the basic target control amount is a basic target gross command pulse width for each of the solenoid valves, and the final target control amount is a final target gross command pulse width for each of the solenoid valves which was obtained by correcting the basic target gross command pulse width according to the gross injection amount and the target gross injection amount. Because the gross command pulse width for the solenoid valve is corrected based on the gross injection amount and the target gross injection amount, the solenoid valve opening period is controlled so that the gross injection amount will match the target gross injection amount, eventually limiting variations of the gross injection amount from the target gross injection amount.

In the fuel injection device for engines in which injectors each have a solenoid valve, the injection characteristic is an initial injection amount, the target injection characteristic is a target initial injection amount, the basic target control amount is a basic target initial command pulse width for each of the solenoid valves, and the final target control amount is a final target initial command pulse width which was obtained by correcting the basic target initial command pulse width according to the initial injection amount and the target initial injection amount. Because the initial command pulse width for the solenoid valve is corrected based on the initial injection amount and the target initial injection amount, the initial opening period of the solenoid valve is controlled so that the initial injection amount will match the target initial injection amount, eventually suppressing variations of the initial injection amount from the target initial injection amount.

In the above fuel injection device for engines, the correction of the basic target control amount for each of the injectors provided in the cylinders of the engine is performed based on the injection characteristic of the associated injector which was determined at the previous fuel injection. The fuel injection characteristic differs from one injector to another because of variations in the component dimensions and assembly precision that may occur during the manufacturing and assembly processes. In multi-cylinder engines, it is necessary to determine the injection characteristic for each of the injectors and to correct the basic target control amounts individually. Executing this correction continuously can deal with changes with time of the injection characteristic of each injector.

In the above fuel injection device for engines, detection signals from the sensors, particularly the common rail pressure that needs to be differentiated at high speed, are converted into digital signals before being supplied to the controller through a high-speed computation device. The high-speed computation device may, for example, be a digital signal processor. Computation burden of the controller can be reduced by providing the high-speed computation device on the sensor side.

BEST MODE FOR CARRYING OUT THE INVENTION

Embodiments of the fuel injection method and device for engines of this invention will be described by referring to the accompanying drawings. The common-rail type fuel injection system to which the engine fuel injection method and device of this invention is applied and also the injectors used in this system may be the conventional ones already described with reference to FIGS. 12 and 13.

The procedure for the fuel injection control of this invention as performed by the controller 12 will be explained for a case where it is applied to a 4-cycle 4-cylinder diesel engine. The engine has first to fourth cylinders arranged in line in this order along the crank shaft. The firing sequence is first cylinder followed by third cylinder, fourth cylinder and second cylinder.

Figure 12:
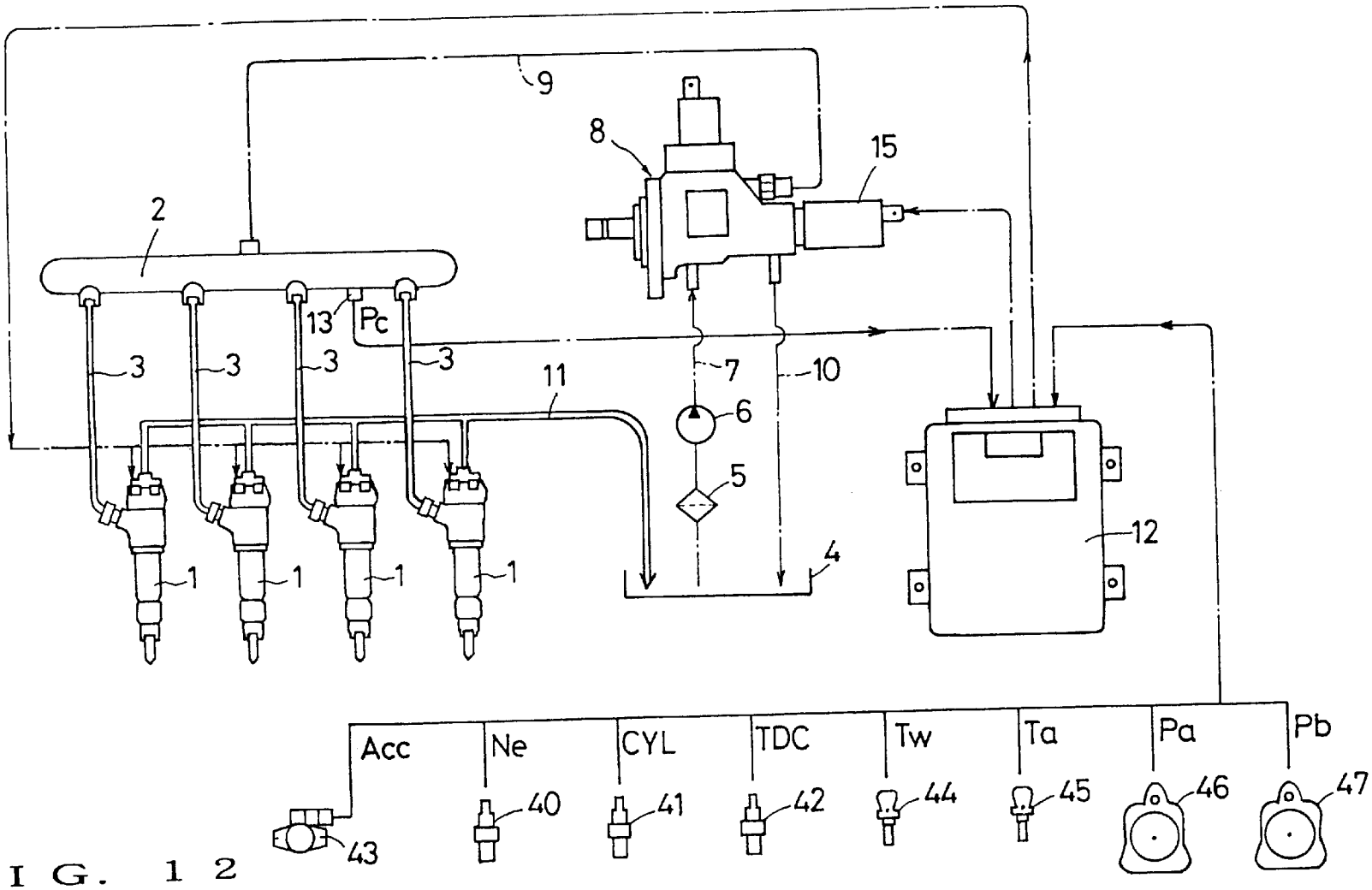
FIG. 12 is a schematic diagram showing an outline of a conventional common-rail type fuel injection system.
Figure 13:
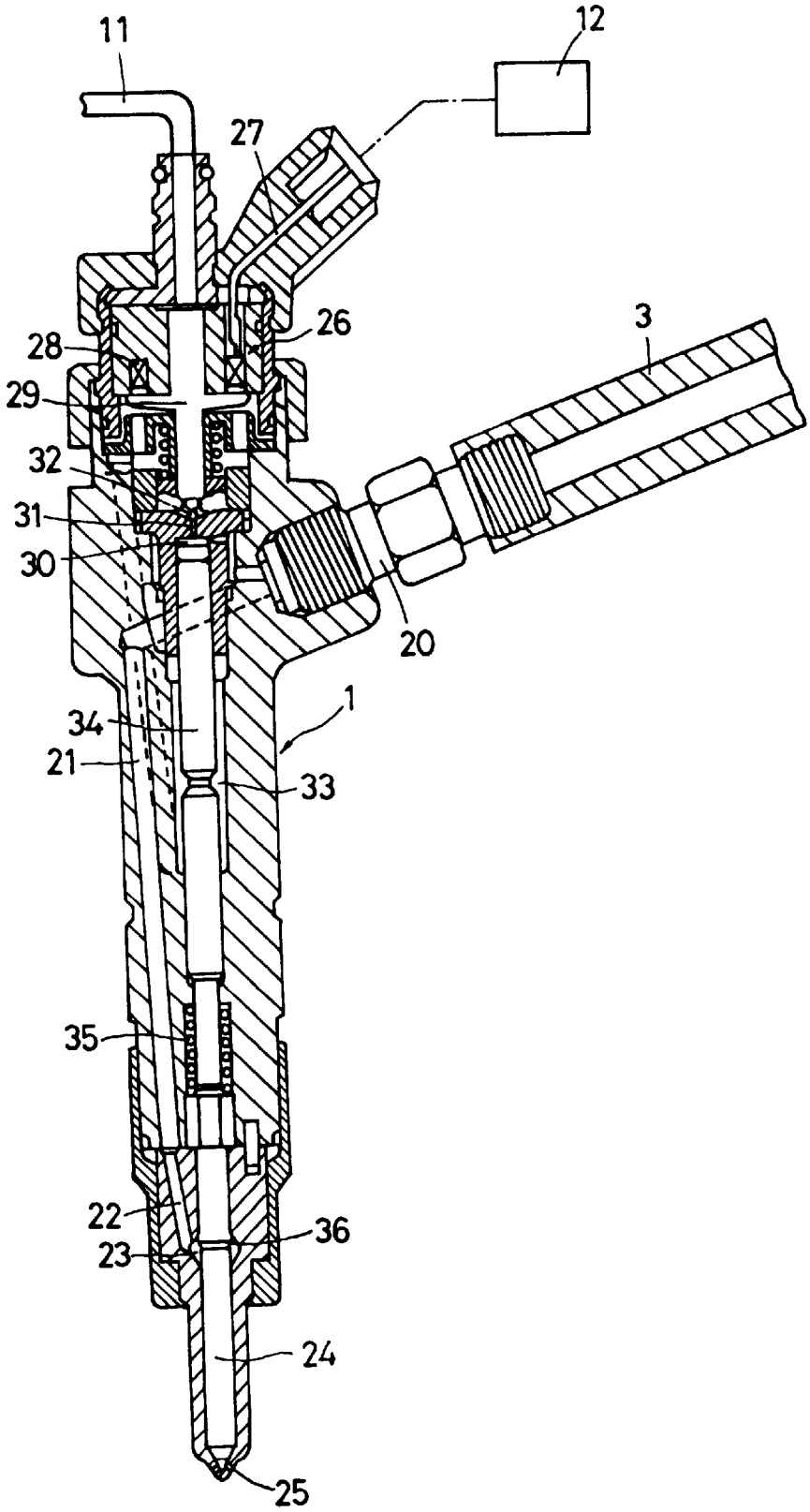
FIG. 13 is a cross section of an example injector used in the conventional common-rail type fuel injection system.

This system, as shown in FIGS. 12 and 13, includes mainly a fuel pump 8, i.e., a variable-displacement high-pressure pump rotating in synchronism with the engine crank shaft; a common rail 2 to store fuel pressurized by the fuel pump 8; injectors 1 to inject high-pressure fuel from the common rail 2 to individual cylinders; sensors 40–47 to detect the operating state of the engine; and a controller 12 to control the fuel injection by sending control signals to the fuel pump 8 and the injectors 1 according to the operating state of the engine. The fuel in the fuel tank 4 is pressurized by the fuel pump 8 and supplied to the common rail 2.

The fuel pump 8 has a fuel pressurizing chamber (not shown) incorporating one or more plungers (not shown) reciprocated by the cam. The fuel pressurizing chamber is selectively connected to a fuel pipe 9 or a return pipe 10 through a flow control valve 15. The fuel pipe 9 is connected to the common rail 2 and the return pipe 10 to the fuel tank 4. The flow control valve 15 is of a type which normally connects the fuel pressurizing chamber to the return pipe 10 but which, when it receives a command pulse from the controller 12 at any timing during the pressurized fuel delivery by the plunger, connects the fuel pressurizing chamber to the fuel pipe 9 until the end of the pressurized fuel delivery by the plunger.

The timing at which the pressurized fuel delivery by the plunger ends is uniquely determined by a cam rotated by the engine output. Controlling the timing at which to start supplying the command pulse, i.e., the timing at which to start the pressurized fuel delivery by the plunger, enables the amount of fuel to be delivered by a single stroke of the plunger, i.e., the amount of fuel to be charged into the common rail 2, to be controlled. Hence, by setting a period during which the fuel pump 8 is to be connected to the common rail 2 while the fuel pump 8 is delivering fuel, the fuel pressure in the common rail (hereinafter referred to as a common rail pressure) can be controlled. The flow control valve may also be a general duty solenoid valve in addition to the type described above.

The common rail pressure is supplied to the injectors 1 of individual cylinders through the branch pipes 3. The injectors 1 have a balance chamber 30 that opens and closes the nozzle holes and a solenoid valve 26 in addition to the nozzle holes and the needle valve. The high-pressure fuel supplied to the injector 1 is mostly led to near the nozzle holes to give the needle valve an opening force while the remaining part of the high-pressure fuel is introduced into the balance chamber 30 to give the needle valve a closing force.

When a command pulse is applied to the solenoid valve 26, the balance chamber 30 is connected to a return pipe 11. The resulting pressure reduction in the balance chamber 30 allows the needle valve to be lifted or opened, executing the fuel injection. Controlling the timing at which to supply the command pulse to the solenoid valve 26 and the period during which to supply that command pulse controls the fuel injection timing and the fuel injection period of the associated injector 1. Because the fuel in the common rail 2 is controlled to a predetermined pressure, the control of the injection timing virtually enables the control of the amount of fuel to be injected. The injector 1 may be of a type in which the balance chamber 30 is omitted and the needle valve is directly driven by the solenoid or piezoelectric element.

The sensors to detect the operating state of the engine may include the following.

(1) Engine revolution speed sensor 40

The engine revolution speed sensor 40 comprises a gear plate mounted to the crank shaft and having a predetermined number of teeth (36 teeth) and a pickup sensor, and calculates the engine revolution speed Ne from the time it takes to input pulses corresponding to a predetermined number of teeth (18 teeth for example).

(2) Engine cylinder determination sensor 41

The engine cylinder determination sensor 41 detects a reference signal, which is used by the controller to identify a cylinder to be controlled. The engine cylinder determination sensor 41 comprises a gear plate mounted to a cam shaft of the high-pressure fuel pump or an intake-exhaust valve driving cam shaft, and a pickup sensor. The gear plate has a tooth (one tooth) corresponding to a particular crank angle (TDC for example) for a particular cylinder (first cylinder for example).

(3) Top dead center (TDC) sensor 42

The top dead center (TDC) sensor 42 detects the top dead center of each cylinder and comprises a gear plate mounted to the cam shaft of the fuel pump 8 or the intake-exhaust valve driving cam shaft, and a pickup sensor. The gear plate has teeth (for example, four teeth) corresponding to the TDC of each cylinder.

(4) Accelerator pedal depression amount sensor 43

The accelerator pedal depression amount sensor 43 detects an amount by which the accelerator pedal is depressed Acc.

(5) Common rail pressure sensor 13

This detects the fuel pressure in the common rail.

Figure 1:
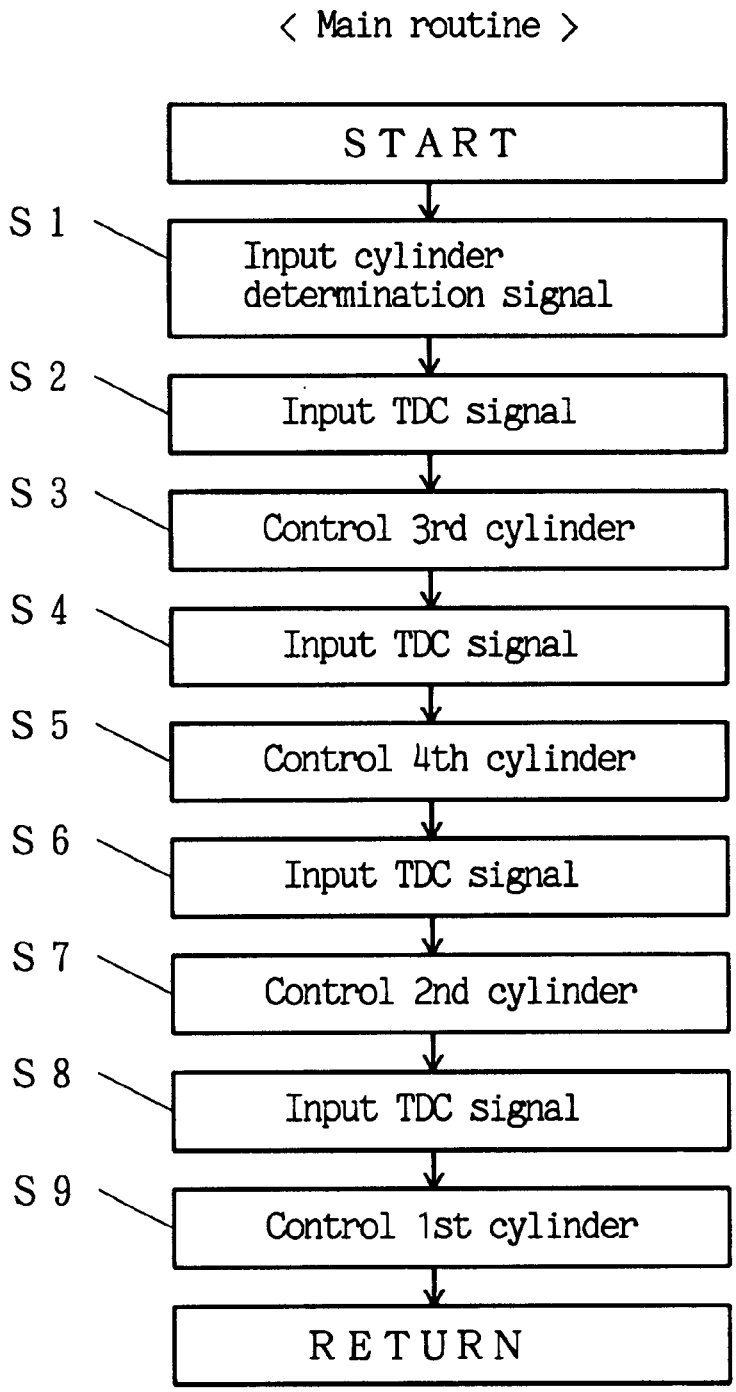
FIG. 1 is a flow chart showing a main routine of an engine control representing the timing and order of cylinder control in the fuel injection method and device for engines of the present invention.
Figure 11:
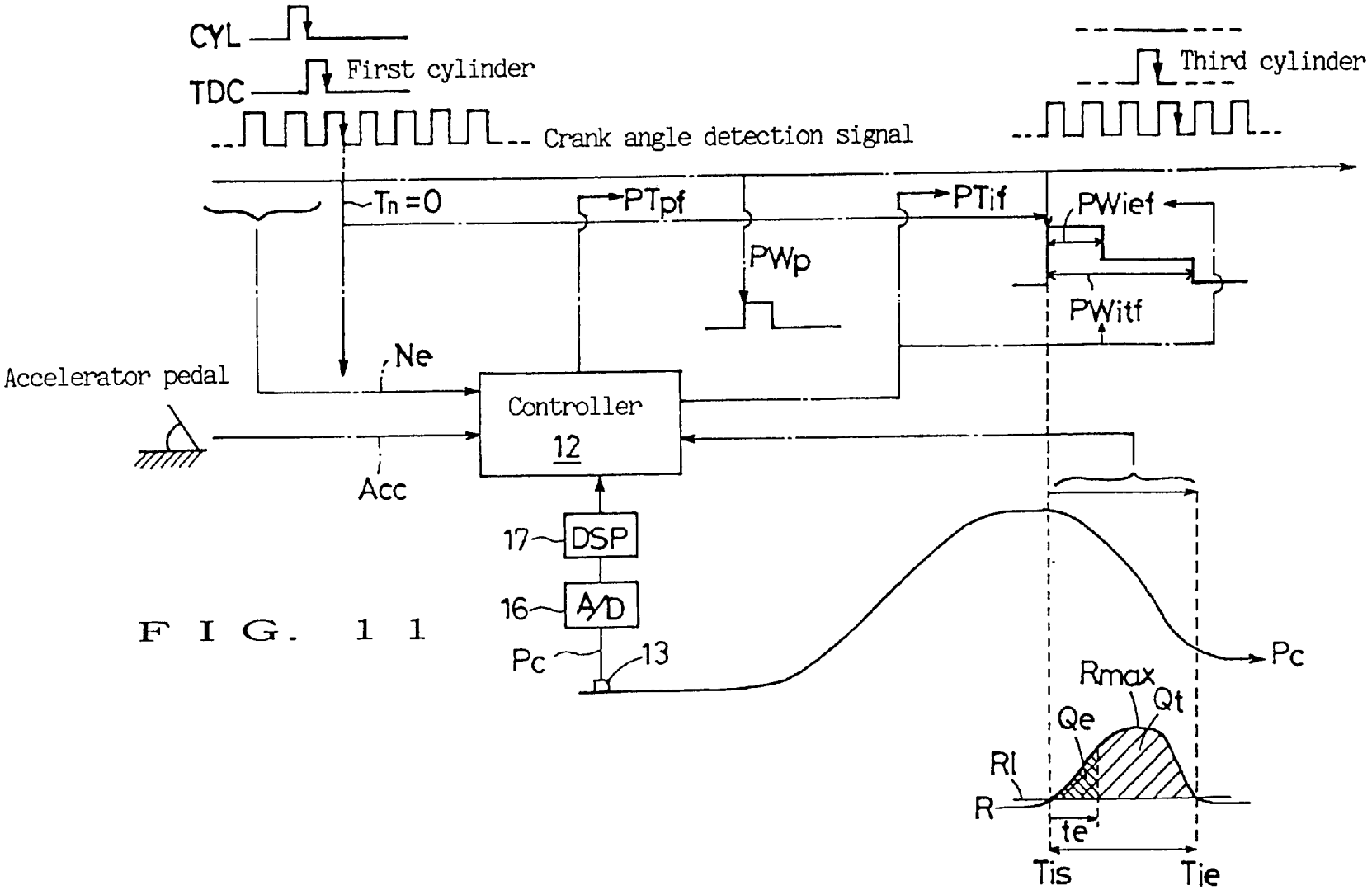
FIG. 11 is a graph showing changes over time of commands, common rail pressure and injection rate in the fuel injection method and device for engines of this invention.

In the system described above, the controller 12 performs various routines shown in the following flow charts. The "main routine" as shown in FIG. 1 performs fuel injection control for each cylinder. When the pulse generation timing of the engine cylinder determination sensor 41 is matched to the top dead center of the first cylinder, the control on each cylinder is performed as follows. Changes over time of the common rail pressure, its differentiated value and various signals are shown in FIG. 11.

(1) When the first cylinder reaches the top dead center, the engine cylinder determination sensor 41 generates a pulse signal as a cylinder determination signal which is then input to the controller 12 (step S1).

(2) The TDC sensor 42 of the first cylinder detects that the first cylinder is at the top dead center, and supplies a pulse signal as the top dead center signal to the controller 12 (step S2).

(3) When the first cylinder reaches the top dead center, the next cylinder to perform combustion is a third cylinder that has finished the intake stroke and is about to enter the compression stroke. Hence, the control on the third cylinder is performed (step S3). That is, the fuel injection control is executed on the third cylinder.

(4) When the third cylinder reaches the top dead center, the TDC sensor 42 of the third cylinder supplies a pulse signal as the top dead center signal to the controller 12 (step S4).

Similarly, the following steps are performed.

(5) Control on the fourth cylinder (step S5).

(6) The TDC sensor 42 of the fourth cylinder that has detected that the fourth cylinder reaches the top dead center supplies a pulse signal to the controller 12 (step S6).

(7) Control on the second cylinder (step S7)

(8) The TDC sensor 42 of the second cylinder that has detected that the second cylinder reaches the top dead center supplies a pulse signal to the controller 12 (step S8).

(9) Another control on the first cylinder (step S9) is executed.

The crank shaft rotates twice while the main routine completes one cycle. In the mean time, the cam shaft needs only to rotate once for intake and exhaust. When the engine is running, the above main routine is repetitively performed.

Figure 2:
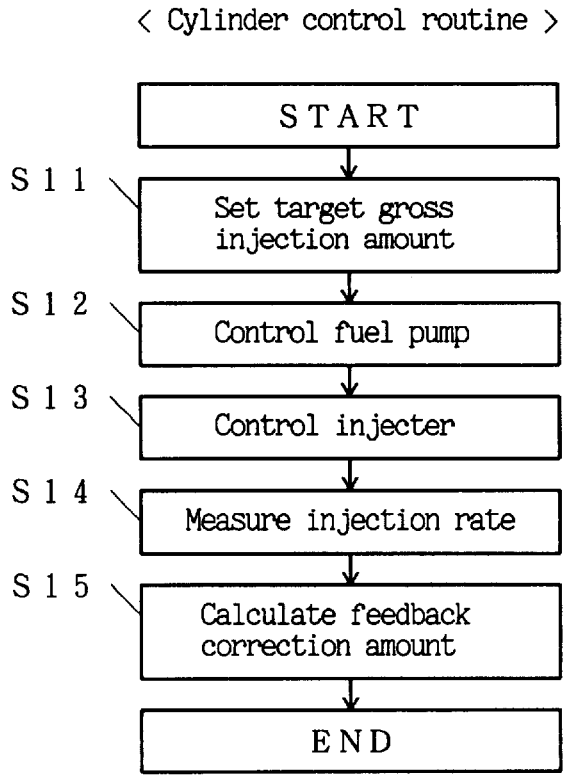
FIG. 2 is a flow chart showing a control routine for each cylinder in the process flow of FIG. 1.

The fuel injection control for the first to fourth cylinders at the steps S3, S5, S7 and S9 is executed according to the "cylinder control routine" shown in FIG. 2. When the cylinder control routine is started, a clock in the controller 12 starts clocking ($T_n$). In the cylinder control routine, various controls are performed as follows.

(1) In the step of "target injection amount setting," the target gross amount of fuel to be injected by one injection from the injector 1 is set for each cylinder (step S11). The setting of the target gross injection amount is performed by using a preset map according to the operating state of the engine as detected by the sensors.

(2) In the step of "fuel pump control," the fuel pump 8 is controlled to control the common rail pressure, which provides the fuel injection pressure, to obtain the target gross injection amount which was set in the preceding step (step S12).

(3) In the step of "injector control," the injection control on the injector 1 is performed under the common rail pressure controlled by the step S12 (step S13). When the cylinder control routine is being repeated, a basic target control amount is set based on target injection characteristics that are determined from the target gross injection amount set by the step S11 and from the common rail pressure controlled by the step S12. The basic target control amount thus set is corrected by a feedback correction amount (described later) determined by the previous cylinder control routine. According to a final target control amount, which was obtained through correction, the fuel injection from the injector 1 is controlled.

(4) In the step of "injection rate measurement," the injection rate of fuel injected by each injector 1 is measured (step S14).

(5) In the step of "feedback correction amount calculation," a feedback correction amount is determined which corrects the basic target control amount so as to eliminate variations in the injection characteristics of each injector 1, i.e., to make the actual injection characteristics match the target injection characteristics (step S15). The feedback correction amount thus obtained is used to correct the basic target control amount for the same injector at step S13 in the next cylinder control routine.

The above steps S11–S15 are performed in this order for each injector 1. Details of each step will be described in the following.

Figure 3:
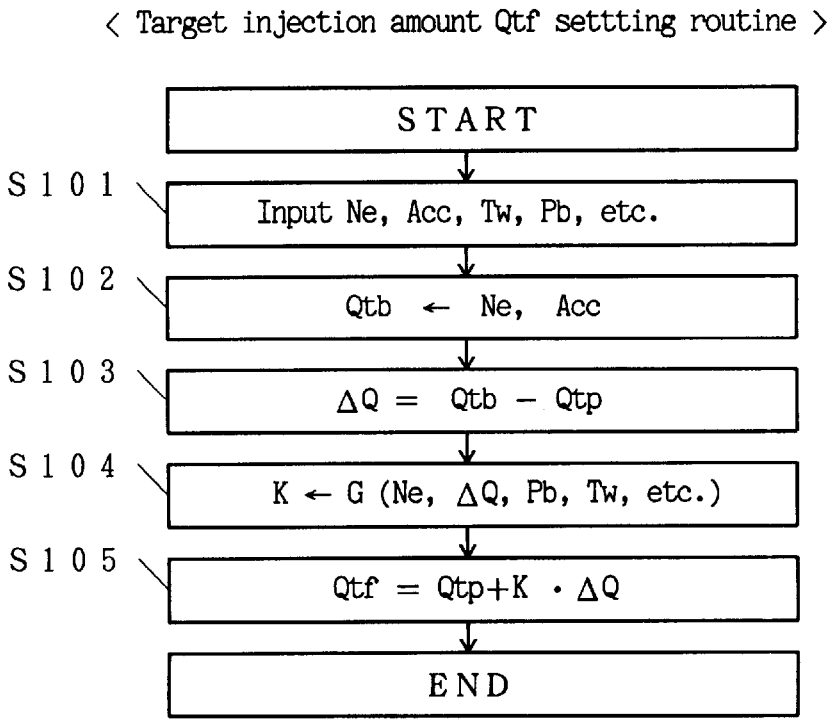
FIG. 3 is a flow chart showing a target injection amount setting routine in the cylinder control process of FIG. 2.

The setting at step S11 of the target amount of fuel to be injected from the injector is executed according to a "routine for setting the target injection amount Qtf" shown in the flow chart of FIG. 3.

(1) After this routine is started, the engine revolution speed Ne and the accelerator pedal depression amount Acc detected by the engine revolution speed sensor 40 and the accelerator pedal depression amount sensor 43 are input to the controller 12 as parameters representing the fundamental operating state of the engine. Additional parameters indicating the operating state of the engine, such as a cooling water temperature (Tw) and an intake pipe inner pressure (Pb), are also supplied to the controller 12 from the corresponding sensors (step S101).

Figure 14:
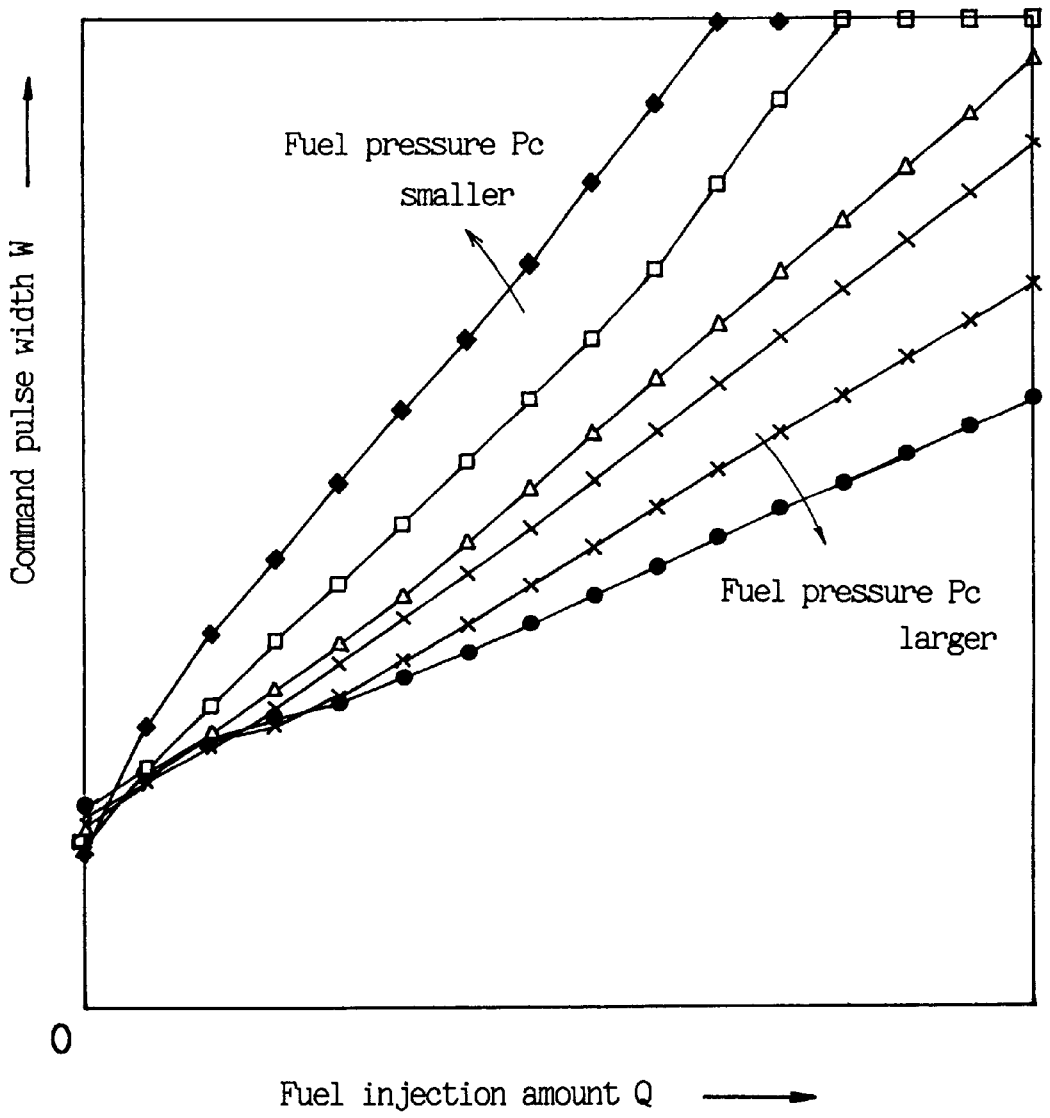
FIG. 14 is a characteristic diagram showing the relation between the fuel injection amount and the width of a command pulse to the solenoid valve in the injector with the common rail pressure taken as a parameter, in the common-rail type fuel injection system.
Figure 15:
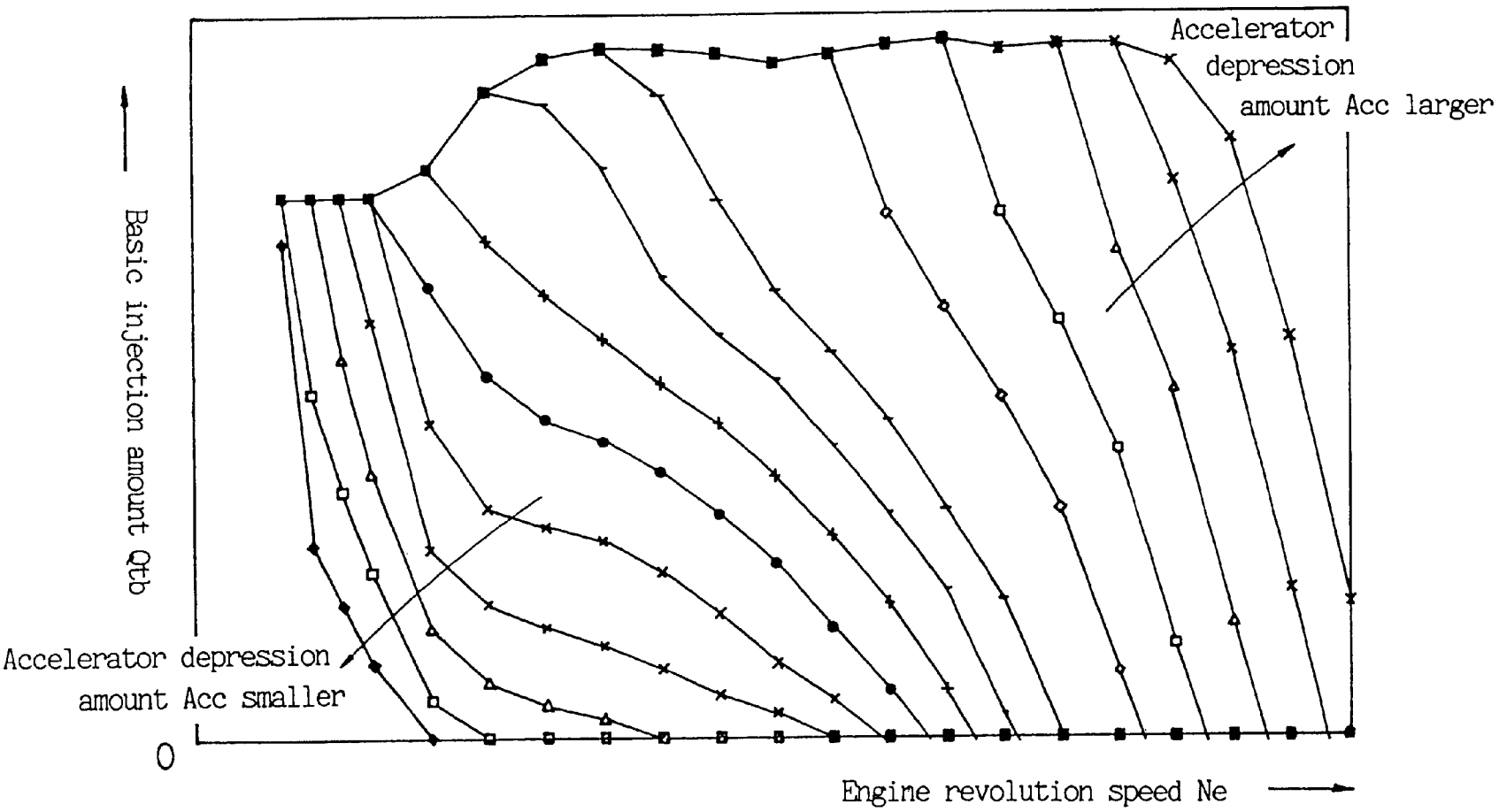
FIG. 15 is a basic injection amount characteristic diagram showing the relation between the engine revolution speed and the basic injection amount with a accelerator pedal depression amount taken as a parameter, in the common-rail type fuel injection system.
Figure 16:
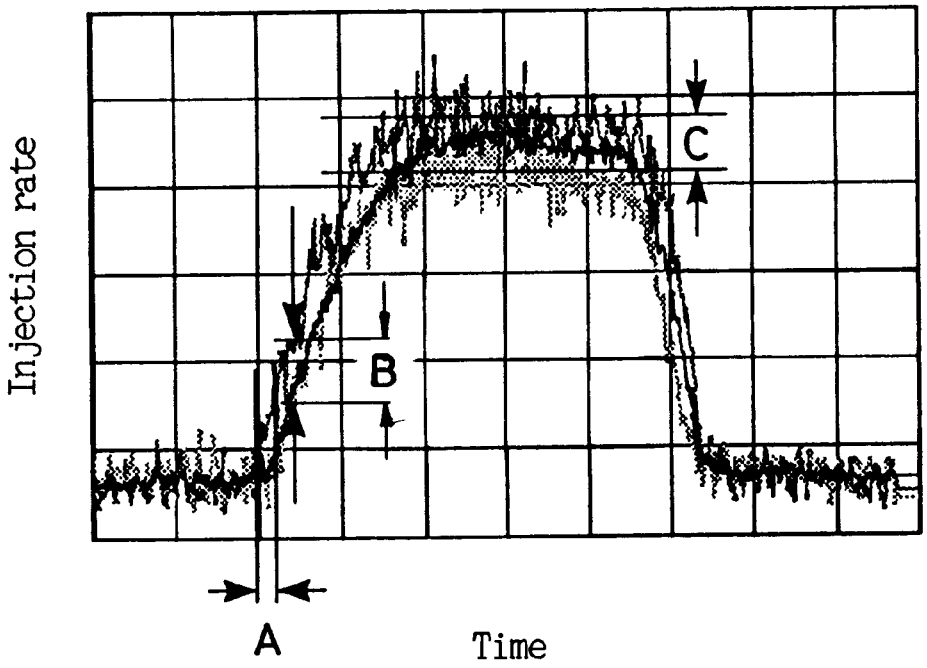
FIG. 16 is a graph showing changes over time of the fuel injection rate of the injector in the conventional common-rail type fuel injection device.

(2) Based on the engine revolution speed Ne and the accelerator pedal depression amount Acc, the basic injection amount characteristic shown in FIG. 14, i.e., the basic target gross injection amount Qtb determined from the two-dimensional map of basic injection amount data, is read into the controller 12 (step S102).

(3) A difference ΔQ between the basic target gross injection amount Qtb and the previously executed gross injection amount Qtp in the associated cylinder, i.e., an increase or decrease in the injection fuel in the same cylinder, is determined (step S103).

(4) According to the parameters (engine revolution speed Ne, ΔQ itself, cooling water temperature Tw, intake pipe inner pressure Pb, etc.) representing the operating state of the engine and detected by the step S101, a predetermined function G for these parameters is used to calculate a correction factor K for correcting ΔQ (step S104).

That is, K=G (Ne, ΔQ, Tw, Pb, etc.)

(5) Based on the previously executed gross injection amount Qtp, the current final target gross injection amount Qtf conforming to the engine operating state is calculated from the following formula using ΔQ determined by step S103 and the correction factor K determined by step S104 (step S105).

$$Qtf=Qtp+K\cdot\Delta Q$$

Although the current final target gross injection amount Qtf was determined by using the ΔQ correction method, it can also be obtained directly by correcting the accelerator pedal depression amount Acc according to the engine operating state during the course of determining the basic injection amount characteristic from the two-dimensional map of basic injection amount data.

Figure 4:
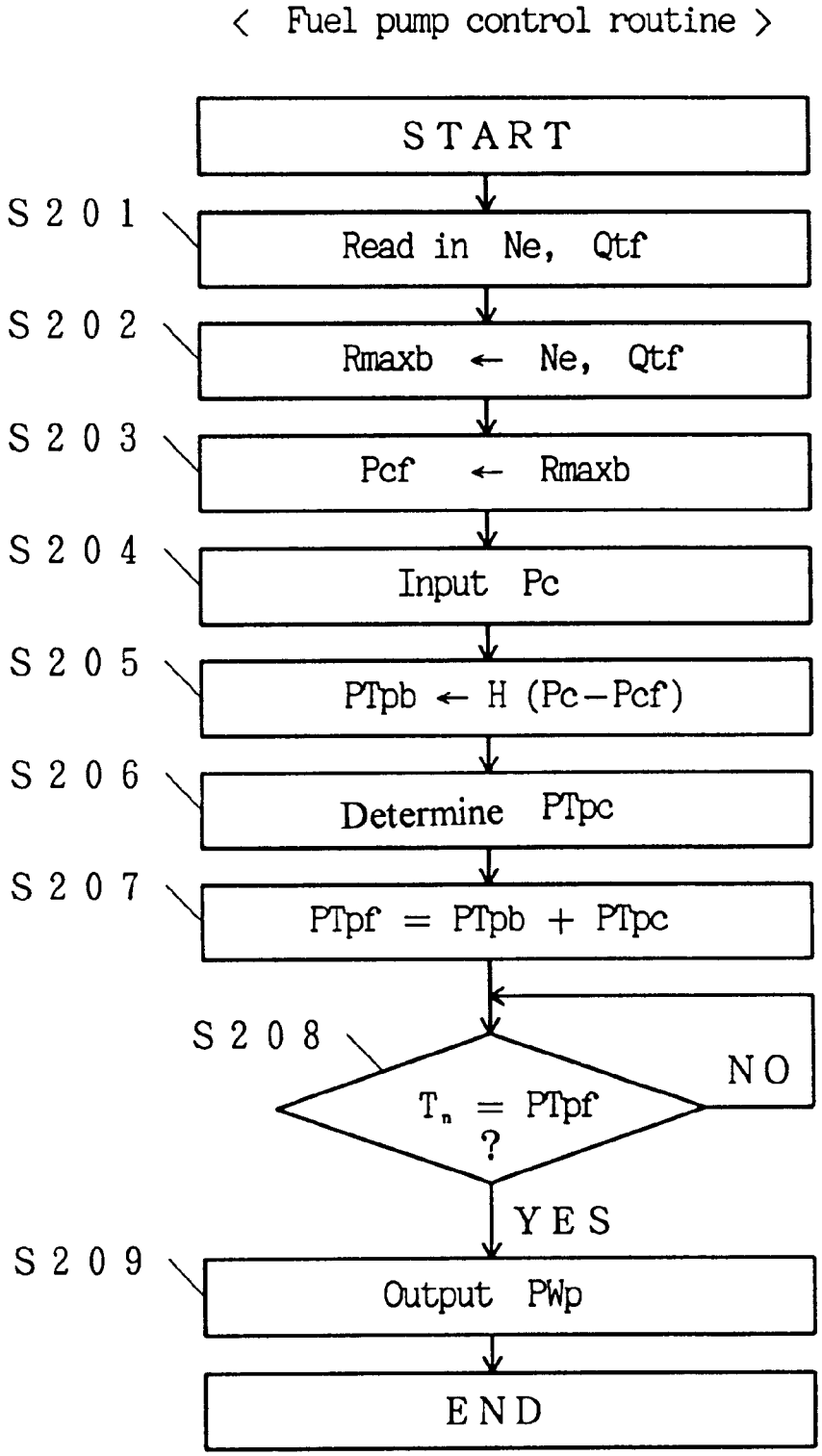
FIG. 4 is a flow chart showing a fuel pump control routine in the cylinder control process of FIG. 2.

The control of the fuel pump is performed according to the "fuel pump control routine" shown in the flow chart of FIG. 4.

(1) The current final target gross injection amount Qtf set by step S105 and the engine revolution speed Ne are read in (step S201).

(2) Based on the current final target gross injection amount Qtf and the engine revolution speed Ne, both read in at step S201, a target maximum injection rate Rmaxb is determined from a prepared map and set (step S202). The target maximum injection rate Rmaxb is one of the target injection characteristics in the fuel injection control for engines of this invention.

(3) For the target maximum injection rate Rmaxb set by step S202, a target common rail pressure Pcf is determined from a predetermined function and set (step S203).

(4) Next, a measured value of the current actual common rail pressure Pc is input (step S204).

(5) A basic target command pulse output timing PTpb for the flow control valve 15 of the fuel pump 8 is calculated by a function H of difference between the target common rail pressure Pcf set by step S203 and the present actual common rail pressure Pc measured by step S204 (step S205). The basic target command pulse output timing PTpb for the flow control valve 15 is one of the basic target control amounts in the fuel injection control for engines of this invention.

(6) A feedback correction amount PTpc (described later) for correcting the output timing of a command pulse to the flow control valve 15 is determined (step S206).

(7) The feedback correction amount PTpc calculated by step S206 is added to the basic target command pulse output timing PTpb determined by step S205 to correct the basic target command pulse output timing PTpb. This correction produces a final target command pulse output timing PTpf as the command pulse output timing to the flow control valve 15, and this final timing is then set (step S207). The final target command pulse output timing PTpf is one of the final target control amounts in the fuel injection control for engines of this invention.

$$PTpf=PTpb+PTpc$$

(8) After this, the operating clock decides whether or not the final target command pulse output timing PTpf has come, i.e., $T_n$=PTpf (step S208). If the final target command pulse output timing PTpf is not yet reached, the step S208 is repeated until it is reached.

(9) When it is decided in step S08 that the final target command pulse output timing PTpf is reached, a command pulse PWp (a fixed value) is output to a flow control valve 15 to cause the fuel to be delivered from the fuel pump 8 to the common rail 2 to control the fuel pressure in the common rail 2 to a pressure that will provide the target maximum injection rate Rmaxb (step S209).

Figure 5:
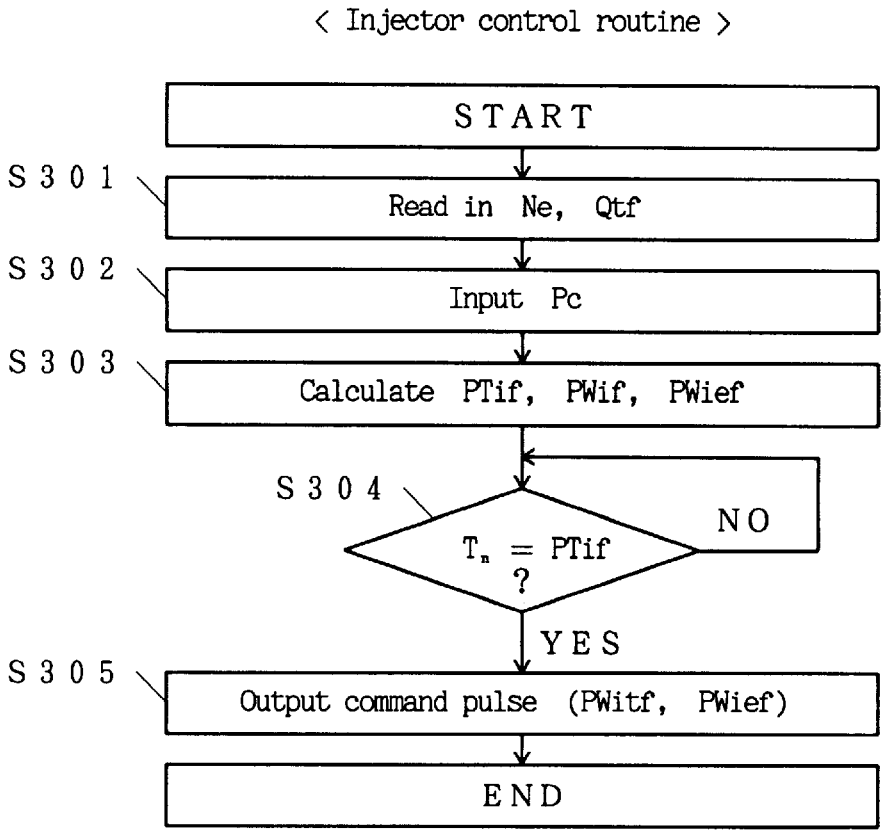
FIG. 5 is a flow chart showing an injector control routine in the cylinder control process of FIG. 2.

Next, the injector control is executed according to the "injector control routine" shown in the flow chart of FIG. 5.

(1) The current final target gross injection amount Qtf set by step S105 and the engine revolution speed Ne are read in (step S301).

(2) The actual common rail pressure Pc measured when the control by step S12 of the fuel pump 8 ends is input (step S302).

(3) The final target command pulse output timing PTif, final target gross command pulse width PWitf and final target initial command pulse width PWief for the solenoid valve 26 of the injector 1 are calculated by the corresponding routines described later and then set (step S303). These output timing PTif, gross command pulse width PWitf and initial command pulse width PWief on the final target command pulse to the solenoid valve 26 of the injector 1 constitute the final target control amount in the fuel injection control for engines of this invention.

(4) Then, the operating clock decides if the final target command pulse output timing PTif for the solenoid valve 26 of the injector 1 has come, i.e., $T_n$=PTif (step S304). If the final target command pulse output timing PTif is not yet reached, the step S304 is repeated until it is reached.

(5) When it is decided that the final target command pulse output timing PTif is reached, the command pulse with the final target gross command pulse width PWitf and the final target initial command pulse width PWief is output to the solenoid valve 26 (step S305).

Figure 7:
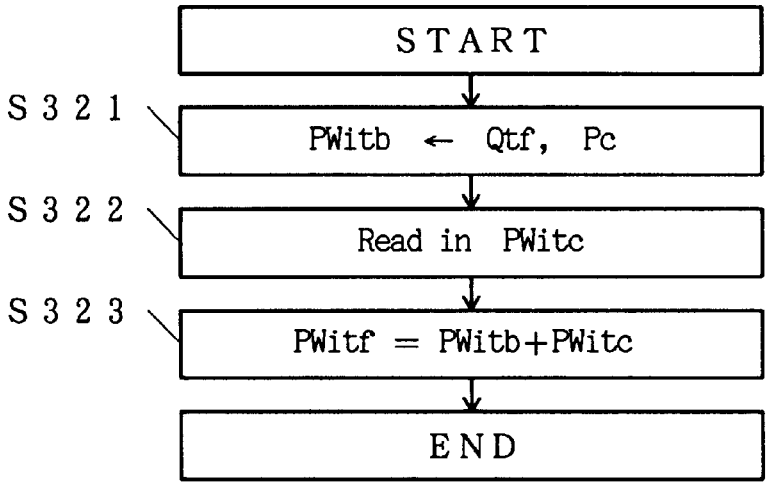
FIG. 7 is a flow chart showing a routine for setting a width of a final target general command pulse to the solenoid valve in the injector control routine of FIG. 5.
Figure 8:
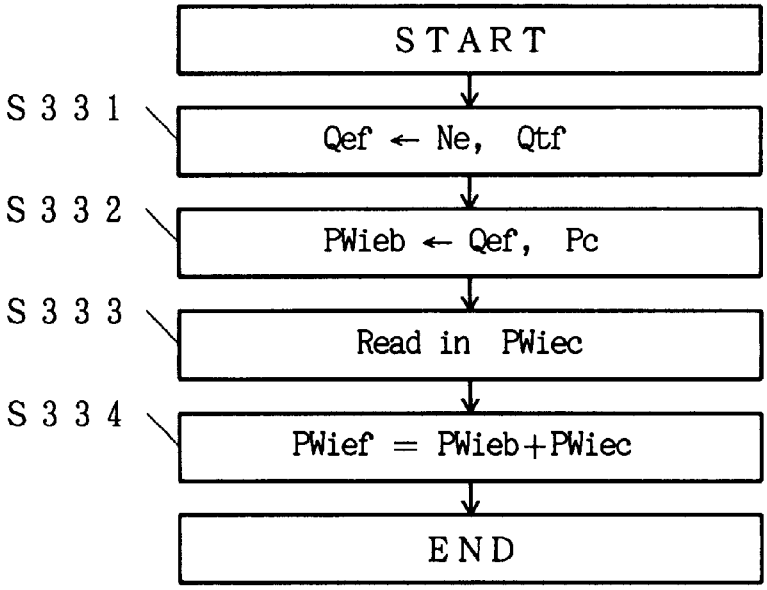
FIG. 8 is a flow chart showing a routine for setting a width of a final target initial command pulse to the solenoid valve in the injector control routine of FIG. 5.

Here, the process of setting the final target command pulse output timing PTif, the final target gross command pulse width PWitf and the final target initial command pulse width PWief will be described in more detail by referring to the setting routines shown in FIGS. 6 to 8.

Figure 6:
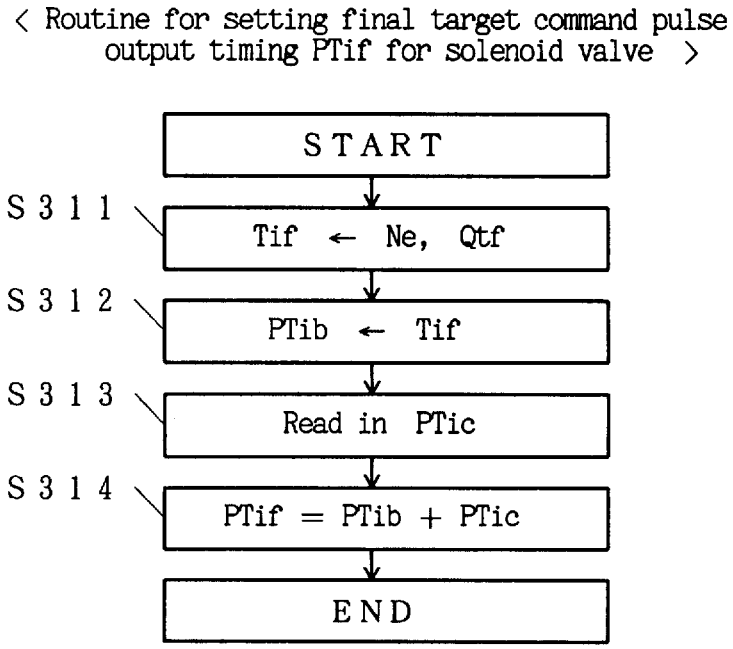
FIG. 6 is a flow chart showing a routine for setting an output timing of a final target command pulse to the solenoid valve in the injector control routine of FIG. 5.

The final target command pulse output timing PTif of the command pulse to be supplied to the solenoid valve 26 of the injector 1 is explained based on the "routine for setting the final target command pulse output timing PTif for the solenoid valve" shown in FIG. 6.

(1) The current final target gross injection amount Qtf set by step S105 and the engine revolution speed Ne are read in.

A target injection timing Tif corresponding to these input values is determined by using a prepared two-dimensional map of target injection timing data and read into the controller 12 (step S311). The target injection timing Tif is one of the target injection characteristics.

(2) Based on the target injection timing Tif read in by step S311, a basic target command pulse output timing PTib as the basic target control amount is set, taking into account electromagnetic and mechanical response delays of the components ranging from the solenoid valve 26 to the needle valve 24 (step S312).

(3) Next, as to the timing for outputting the command pulse to the solenoid valve 26, a feedback correction amount PTic (described later as part of the detailed description of step S15), already obtained by the previously executed cylinder control routine, is read in (step S313).

(4) The feedback correction amount PTic read in by step S313 is added to the basic target command pulse output timing PTib set by step S312 to correct the basic target command pulse output timing PTib and thereby produce a final target command pulse output timing PTif, which is set as a final target control amount (step S314).

The final target gross command pulse width PWitf of the command pulse supplied to the solenoid valve 26 of the injector 1 will be described by referring to the "routine for setting the final target gross command pulse width PWitf for the solenoid valve" shown in FIG. 7.

(1) Based on the current final target gross injection amount Qtf set by step S105 and the actual common rail pressure Pc determined by step S302 when the fuel pump control of step S12 is finished, a basic target gross command pulse width PWitb is determined from a two-dimensional map of basic target gross command pulse width data and then read in (step S321). In the setting of the final target gross command pulse width PWitf, the current final target gross injection amount Qtf constitutes the target injection characteristics.

(2) Next, as to the command pulse to be supplied to the solenoid valve 26, a feedback correction amount PWitc for the gross command pulse width (described later as part of the detailed description of step S15) that is already determined by the previously executed cylinder control routine is read in (step S322).

(3) The feedback correction amount PWitc for the gross command pulse width read in by step S322 is added to the basic target gross command pulse width PWitb set by step S321 to correct the basic target gross command pulse width PWitb and thereby produce a final target gross command pulse width PWitf, which is set as a final target control amount (step S323).

The final target initial command pulse width PWief of a command pulse to the solenoid valve 26 of the injector 1 will be explained by referring to the "routine for setting the final target initial command pulse width PWief" shown in FIG. 8.

(1) Based on the current final target gross injection amount Qtf set by step S105 and the engine revolution speed Ne read in, a corresponding target initial injection amount Qef, i.e., a target injection amount during the ignition delay period te (fixed value), is determined from a prepared two-dimensional map of target initial injection amount data and read into the controller 12 (step S331). In the setting of the final target initial command pulse width PWief for the solenoid valve, the target initial injection amount Qef is the target injection characteristics.

(2) By using the target initial injection amount Qef read in by step S331 and the common rail pressure Pc, a basic target initial command pulse width PWieb is determined from a prepared two-dimensional map of basic target initial command pulse width data and read in (step S332).

(3) Next, as for the command pulse to the solenoid valve 26, a feedback correction amount PWiec for the initial command pulse width (described later as part of the detailed description of step S15) that is already determined in the previously executed cylinder control routine is read in (step S333).

(4) The feedback correction amount PWiec for the initial command pulse width read in by step S333 is added to the basic target initial command pulse width PWieb set by step S332 to correct the basic target initial command pulse width PWieb and thereby produce a final target initial command pulse width PWief, which is set (step S334).

Figure 9:
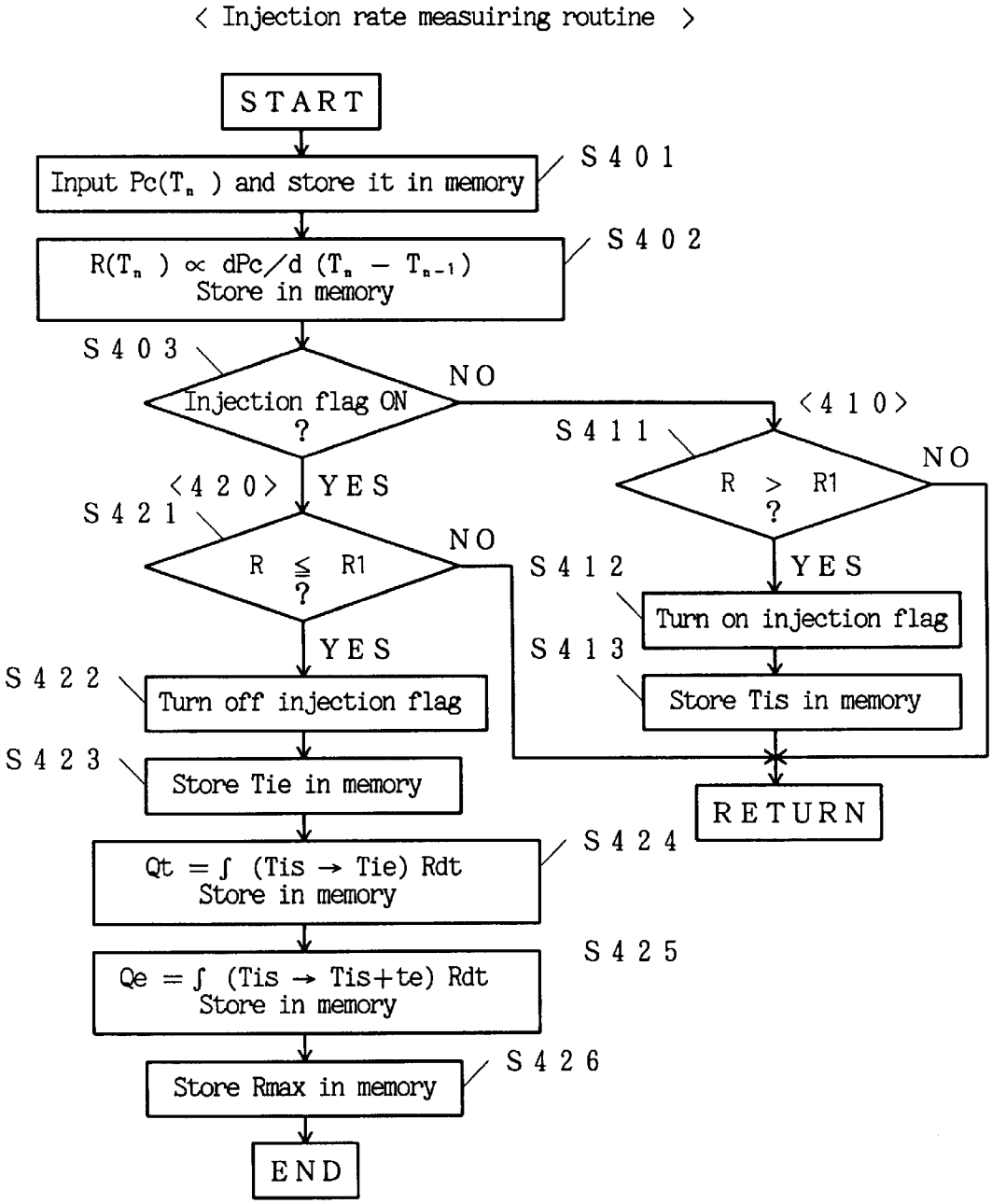
FIG. 9 is a flow chart showing an injection rate measuring routine in the cylinder control process of FIG. 2.

Next, the measurement of injection rate will be described in more detail by referring to the "injection rate measuring routine" shown in FIG. 9. The injection rate measuring routine is executed in the following steps, triggered by the output of a command pulse from the injector control routine.

(1) Following the start of this routine, the common rail pressure sensor 13 detects a common rail pressure $Pc(T_n)$ at time $(T_n)$ which is stored in memory of the controller 12 (step S401).

(2) By using the common rail pressure $Pc(T_n)$ at this time and the common rail pressure $Pc(T_{n-1})$ one sampling cycle before, the differential value $R(T_n)$ of the common rail pressure Pc is calculated from the following formula (step S402). The coefficient used for the conversion from $\Delta Pc/\Delta T$ to $R(T_n)$ is obtained from tests.

$$R(T_n) \propto \frac{\Delta Pc}{\Delta T} = \frac{Pc(T_n) - Pc(T_{n-1})}{T_n - T_{n-1}}$$

(3) Next, it is checked whether the injection execution flag (detailed later) is ON or OFF. When the injection execution flag is OFF, the process goes to a routine 410. When the injection execution flag is ON, the process proceeds to routine 420 (step S403). It is noted, however, that in the first time processing the process moves to the routine 410.

(4) The routine 410 compares the differential value R of the common rail pressure Pc and a predetermined slice level (injection execution decision value) R1 (step S411). When R is equal to or smaller than R1, i.e., when the injection is not executed and the rate of change of the common rail pressure Pc is small, it is decided that the injection has not yet been started and the process returns to the start where it continues to detect the common rail pressure $Pc(T_n)$.

(5) When, after some repetition of the above steps, the actual injection is started and the differential value R of the common rail pressure Pc exceeds the injection execution decision value R1, the injection flag is turned ON (step S412) and the time Tis when the flag was turned on is stored in memory as the injection start time (step S413).

(6) The process returns again to the start and executes steps S401 and S402. Because the injection flag is already ON at step S403, the process moves to the routine 420.

(7) The routine 420 compares again the differential value R of the common rail pressure Pc with the injection execution decision value R1 (step S421). While the differential value is in excess of the injection execution decision value R1, the process returns to the start where it continues to detect the common rail pressure $Pc(T_n)$.

(8) When, after the actual injection is finished, the differential value R of the common rail pressure Pc is equal to or less than the injection execution decision value R1, which means that there is almost no change in the common rail pressure Pc, i.e., the fuel injection has finished, the routine after the decision step S421 turns the injection flag OFF (step S422) and stores in memory the time Tie when the injection flag was turned off (step S423).

(9) The differential value R of the common rail pressure Pc is integrated over a time period from the injection start time Tis to the injection end time Tie to determine the gross injection amount Qt executed, which is then stored in memory (step S424).

(10) The differential value R of the common rail pressure Pc is integrated over an initial injection period te (i.e., ignition delay period) starting at the injection start time Tis to determine an initial injection amount Qe executed, which is then stored in memory (step S425).

(11) The maximum of the differential value R of the common rail pressure Pc (for example, an average of differential values R at two or more points near the maximum value) is stored in memory as a maximum injection rate Rmax (step S426).

Figure 10:
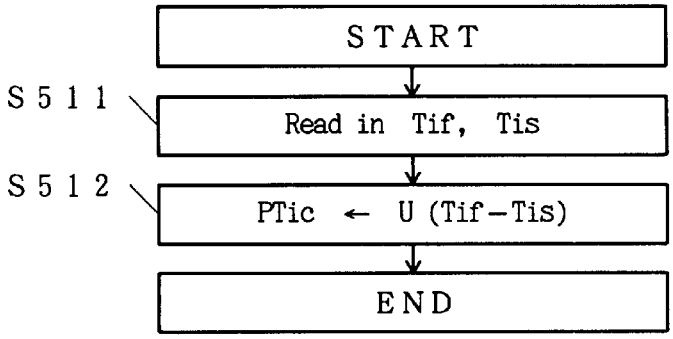
FIG. 10 is flow charts showing calculation routines of feedback correction amounts to be read into the processes of FIGS. 4, 6, 7 and 8.
Figure 10:
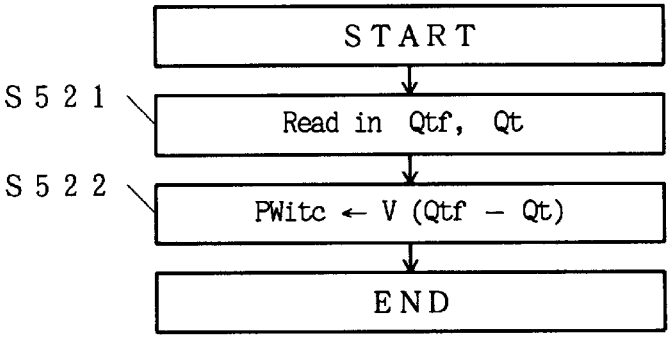
Figure 10:
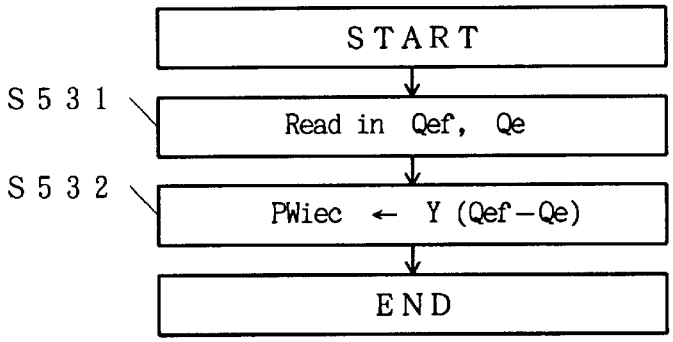
Figure 10:
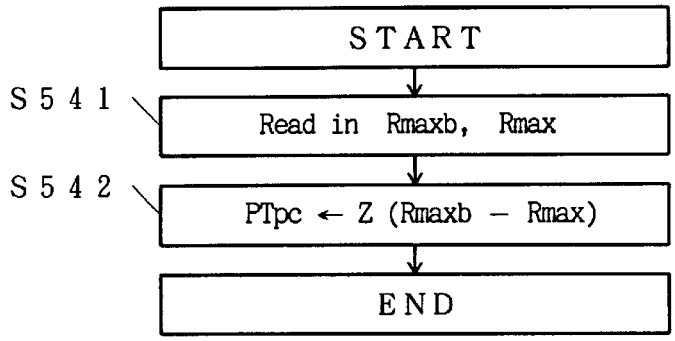

Finally, the calculation by step S15 of the feedback correction amount will be detailed by referring to the "feedback correction amount calculation routine" shown in FIG. 10. The correction amounts for the basic target control amounts are determined from the target injection characteristics, which were obtained by executing the fuel pump control routine and the injector control routine, and from the executed injection characteristics measured by the injection rate measuring routine. Each of the correction amounts is calculated as a predetermined form of function corresponding to the difference between the target injection characteristic and the previously executed injection characteristic.

First, in the feedback correction amount PTic routine 510, the feedback correction amount for the output timing of the command pulse to the solenoid valve 26 of the injector 1 is determined, for the control of the command pulse output timing, from the target injection timing Tif as the target injection characteristic and from the injection start time Tis as the measured actual injection characteristic. That is, the target injection timing Tif and the injection start time Tis—which is the actual injection start time—for the associated injector are read in (step S511) and a feedback correction amount PTic is obtained from the function U of a difference (Tif−Tis) (step S512). The feedback correction amount PTic thus obtained is read in by the routine of FIG. 6 that sets the final target command pulse output timing PTif for the solenoid valve (step S313). The feedback correction amount PTic is then added to the basic target command pulse output timing PTib set by step S312 to produce a final target command pulse output timing PTif for the solenoid valve 26 of the injector 1, which is then set as a final target control amount (step S314).

Next, in the feedback correction amount PWitc routine 520, the feedback correction amount for the gross command pulse width of the command pulse to the solenoid valve 26 of the injector 1 is determined, for the control of the gross command pulse width, from the final target gross injection amount Qtf as the target injection characteristic and from the gross injection amount Qt as the measured actual injection characteristic. That is, the final target gross injection amount Qtf and the gross injection amount Qt—which is the actual gross injection amount—for the associated injector are read in (step S521) and a feedback correction amount PWitc is determined from the function V of a difference (Qtf−Qt) (step S522). The feedback correction amount PWitc thus obtained is read in by the routine of FIG. 7 that sets the final target gross command pulse width PWitf for the solenoid valve (step S322). The feedback correction amount PWitc is then added to the basic target gross command pulse width PWitb set by step S321 to produce a final target gross command pulse width PWitf to be output to the solenoid valve 26 of the injector 1, which is set as a final target control amount (step S323).

Next, in the feedback correction amount PWiec routine 530, the feedback correction amount for the initial command pulse width of the command pulse to be output to the solenoid valve 26 of the injector 1 is determined, for the control of the initial command pulse width, from the target initial injection amount Qef as the target injection characteristic and from the initial injection amount Qe as the measured actual injection characteristic. That is, the target initial injection amount Qef and the initial injection amount Qe—which is the actual initial injection amount—for the associated injector are read in (step S531) and a feedback correction amount PWiec is determined from the function Y of a difference (Qef−Qe) (step S532). The feedback correction amount PWiec thus obtained is read in by the routine of FIG. 8 that sets the final target initial command pulse width PWief for the solenoid valve (step S333). The feedback correction amount PWiec is added to the basic target initial command pulse width PWieb set by step S332 to produce a final target initial command pulse width PWief for the solenoid valve 26 of the injector 1, which is set as a final target control amount (step S334).

Finally, in the feedback correction amount PTpc routine 540, the feedback correction amount for the output timing of the command pulse to the flow control valve 15 provided in conjunction with the fuel pump 8 is determined, for the control of the command pulse output timing, from the target maximum injection rate Rmaxb as the target injection characteristic and from the maximum injection rate Rmax as the measured actual injection characteristic. That is, the target maximum injection rate Rmaxb and the maximum injection rate Rmax—which is the actual maximum injection rate determined by S426 of FIG. 9—for the associated injector are read in (step S541) and a feedback correction amount PTpc for the output timing of the command pulse to the fuel pump is determined by the function Z of a difference (Rmaxb−Rmax) (step S542). The feedback correction amount PTpc thus obtained is read in by the fuel pump control routine shown in FIG. 4 (step S206) and is added to the basic target initial command pulse output timing PTpb to produce a final target command pulse output timing PTpf for the command pulse to be output to the flow control valve 15 of the fuel pump 8. The final target command pulse output timing PTpf is set as a final target control amount (step S207). Next, the fuel injection control for engines of this invention will be explained as related to the elapse of time by referring to FIG. 11. It is assumed that a previous fuel injection control was performed on the third cylinder two crank shaft rotations before.

(1) When an output pulse of a cylinder determination signal CYL provided to the first cylinder is detected, a top dead center signal TDC indicating that the first cylinder has reached the top dead center is output at the trailing edge of the cylinder determination signal CYL pulse. At the trailing edge of the top dead center signal TDC, the engine revolution speed sensor 40, which comprises a gear plate having a predetermined number of teeth (36 teeth for example) and attached to the crank shaft and a pickup sensor, produces a pulse signal. At the trailing edge of the pulse signal from the engine revolution speed sensor 40, a clock $T_n$ in the controller 12 is started ($T_n$=0). The pulse signal from the engine revolution speed sensor 40 along with the accelerator pedal depression amount Acc is input to the controller 12. Further, the common rail pressure Pc is also detected according to the clock $T_n$ so that it can finally be treated as a digital value. The common rail pressure Pc is used to calculate the fuel injection rate as a value proportional to the rate of change of the common rail pressure Pc between the adjacent clocks $T_n$. Upon detecting the top dead center signal TDC indicating that the first cylinder has reached the top dead center, the fuel injection control is performed on the third cylinder, the next cylinder to arrive at the top dead center.

(2) Based on the engine revolution speed Ne and the accelerator pedal depression amount Acc, the current basic target gross injection amount Qtb is determined from the two-dimensional map of target injection amount data. The current final target gross injection amount Qtf, which was corrected based on the difference between the previous basic target gross injection amount Qptb and the current basic target gross injection amount Qtb, is set. Based on the final target gross injection amount Qtf thus set and the engine revolution speed Ne, the target maximum injection rate Rmaxb is set from the two-dimensional map of target maximum injection rate data. To obtain the target maximum injection rate Rmaxb, the target common rail pressure Pcf is set and the basic target command pulse output timing PTpb for the command pulse to be output to the flow control valve 15 provided on the delivery side of the fuel pump 8 is determined according to the difference between the present common rail pressure Pc and the target common rail pressure Pcf. That is, the magnitude of the common rail pressure Pc can be controlled by the period, from the basic target command pulse output timing PTpb to the end of the plunger stroke, during which the fuel is delivered from the fuel pump 8 to the common rail 2 through the flow control valve 15. The earlier the basic target command pulse output timing PTpb, the higher the common rail pressure Pc will be when the fuel is to be injected.

The above method alone, however, cannot produce the target maximum injection rate Rmaxb correctly because of variations and changes with time of individual components in a fuel supply system. For this reason, the following steps are taken. That is, a maximum injection rate is determined averagely from discrete injection rates $R(T_n)$ that are based on the differentials (rates of change) of the common rail pressure Pc at the previous fuel injection, and a feedback correction amount PTpc is determined from the difference between the target maximum injection rate Rmaxb and the maximum value of the previous injection rate R of the same cylinder. The current basic target command pulse output timing PTpb is corrected by the above feedback correction amount PTpc to produce and set a final target command pulse output timing PTpf. A command pulse based on the final target command pulse output timing PTpf is output to the flow control valve 15.

(3) As determined by the above (2), the fuel injection command is sent to the solenoid valve 26 of the injector 1 from the controller 12 when the common rail pressure Pc is maximum. When the engine revolution speed Ne and the final target gross injection amount Qtf set are read in and the common rail pressure Pc is input, three injection conditions for the solenoid valve 26 of the injector 1—the basic target command pulse output timing PTib, the basic target gross command pulse width PWitb and the basic target initial command pulse width PWieb—are determined from a map using the current final target gross injection amount Qtf and the engine revolution speed Ne or the common rail pressure Pc. If the common rail pressure Pc is already determined, the control on the fuel injection amount and the fuel injection rate can be determined by these three fuel injection conditions for the injector 1.

With the above method alone, however, the above three quantities cannot be determined correctly because of variations and changes with time of individual components in the fuel supply system. For this reason, the common rail pressure Pc at each previous injection is differentiated and the above three quantities for the current fuel injection in the associated cylinder are corrected using the differentiated value. That is, based on this differential value, the actual timing Tis when the common rail pressure Pc began to change at the previous injection is determined. According to the difference between Tis and the target injection timing Tif for the previous injection, the feedback correction amount PTic of the command pulse output timing is determined. In the process of the present injection in the associated cylinder, the basic target command pulse output timing PTib for the current injection is corrected by using the feedback correction amount PTic.

The basic target gross command pulse width PWitb is closely related to the amount of fuel to be injected. Hence, the following steps are taken. The feedback correction amount PWitc for the gross command pulse width is determined based on the difference between the gross injection amount Qt, which was obtained by integrating the differentiated value of the common rail pressure Pc at the previous injection over the injection period (Tie−Tis), and the final target gross injection amount Qtf. The basic target gross command pulse width PWitb for the current injection is corrected by the above feedback correction amount PWitc.

Further, as for the basic target initial command pulse width PWieb, too, the feedback correction amount PWiec for the initial command pulse width is determined based on the difference between the initial injection amount Qe, which was obtained by integrating the differentiated value of the common rail pressure Pc at the previous injection over the initial injection period tf, and the target initial injection amount Qef. The basic target initial command pulse width PWieb for the current injection is corrected by the above feedback correction amount PWiec.

The signal from the pressure sensor 13 which detects the common rail pressure Pc is sent through an A/D converter 16 and a digital signal processor (DSP) 17, a high speed calculation device, to the CPU of the controller 12 to reduce the computation burden of the controller 12.

Industrial Applicability

The fuel injection device for engines according to the present invention, as described above, corrects various quantities concerning the current fuel injection command pulse to the flow control valve installed in the fuel path connecting the fuel pump and the common rail and to the solenoid valve provided in the injector, according to various data obtained from the differentiated value of the common rail pressure at the previous fuel injection in the same injector. With this correction, it is possible to compensate for manufacturing and assembly variations and changes with time of fuel injection-related components such as injectors and to perform fuel injection under optimum conditions, thereby limiting the production of hydrocarbon emissions and soot in the exhaust gas due to combustion variations and reducing engine noise and vibrations.

What is claimed is:

1. A fuel injection method for a engine having a common rail which stores fuel delivered by a fuel pump, and injectors which are respectively supplied with the fuel from the common rail, comprising:

(a) detecting engine operating states by sensors, (b) setting a target injection characteristic by a controller based on the detected engine operating state, (c) setting a basic target control amount based on the target injection characteristic, (d) detecting an actual injection characteristic based on a changing ate over time of fuel pressure in the common rail following fuel injection from an individual injector of the engine, (e) setting a final target control amount which is obtained by correcting the basic target control amount based on both the target injection characteristic and the actual injection characteristic, and (f) executing fuel injection from the injector based on the final target control amount.

2. A fuel injection method for engines according to claim 1, wherein the actual injection characteristic includes at least an actual maximum injection rate determined according to a maximum value of the changing rate of the fuel pressure, an actual injection start timing determined as a time when the changing rate of the fuel pressure exceeds a predetermined value, and an actual gross injection amount determined according to an integrated value obtained by integrating the changing rate of the fuel pressure over a fuel injection period or an actual initial injection amount determined according to an integrated value obtained by integrating the changing rate of the fuel pressure over an initial injection period; wherein the target injection characteristic includes at least a target maximum injection rate of the fuel, a target injection start timing, and a target gross.

3. A fuel injection method for engines according to claim 2, wherein the actual injection characteristic is determined based on a smoothed characteristic curve of the changing rate of the pressure.

4. A fuel injection method for engines according to claim 2, wherein the actual injection characteristic is the maximum actual injection rate, the basic target control amount is a basic target command pulse output timing which is calculated, according to the target maximum injection rate, for a basic target command pulse to be output to a flow control valve provided in the fuel flow paths connecting the fuel pump and the common rail, and the final target control amount is a final target command pulse output timing which is obtained by correcting the basic target command pulse output timing so that the actual maximum injection rate will be equal to the target maximum injection rate.

5. A fuel injection method for engines according to claim 2, wherein the actual injection characteristic is the actual injection start timing, the basic target control amount is a basic target command pulse output timing which is calculated, according to the target injection start timing of each injector, for a basic target command pulse to be output to a solenoid valve provided in each of the injectors to control the opening and closing of the nozzle holes formed in the injectors, and the final target control amount is a final target command pulse output timing which is obtained by correcting the basic target command pulse output timing so that the actual injection start timing agrees with the target injection start timing.

6. A fuel injection method for engines according to claim 2, wherein the actual injection characteristic is the actual gross injection amount, the basic target control amount is a basic target gross command pulse width which is calculated, according to the target gross injection amount, for a basic target command pulse to be output to a solenoid valve provided in each of the injectors to control the opening and closing of the nozzle holes formed in the injectors, and the final target control amount is a final target gross command pulse width which is obtained by correcting the basic target gross command pulse width so that the actual gross injection amount agrees with the target gross injection amount.

7. A fuel injection method for engines according to claim 2, wherein the actual injection characteristic is the actual initial injection amount, the basic target control amount is a basic target initial command pulse width which is calculated, according to the target initial injection amount corresponding to the target gross injection amount, for a basic target initial command pulse to be output to a solenoid valve provided in each of the injectors to control the opening and closing of the nozzle holes formed in the injectors, and the final target control amount is a final target initial command pulse width which is obtained by correcting the basic target initial command pulse width so that the actual initial injection amount is equal to the target initial injection amount.

8. A fuel injection method for engines according to claim 1, wherein the engine has cylinders, and the correction of the basic target control amount for each of the injectors installed in the cylinders is performed based on the injection characteristic of the associated injector that was determined at the previous fuel injection.

9. A fuel injection device for engines comprising:

a common rail for storing fuel delivered by a fuel pump;

injectors for injecting from nozzle holes into combustion chambers of the engine the fuel supplied from the common rail through fuel flow paths; sensors for detecting an operating state of the engine; and a controller for setting a target injection characteristic according to detection signals from the sensors and for setting a basic target control amount corresponding to the target injection characteristic to execute the fuel injection by each of the injectors;

wherein the controller determines the actual injection characteristic for each of the injectors according to a changing rate over time of a fuel pressure in the common rail following the fuel injection, sets a final target control amount which was obtained by correcting the basic target control amount according to the target injection characteristic and the actual injection characteristic to eliminate variations of the actual injection characteristic of each injector, and controls the actual injection characteristic of each injector according to the final target control amount.

10. A fuel injection device for engines according to claim 9, wherein the fuel pump is connected to the common rail through a flow control valve which controls the amount of fuel to be delivered to the common rail according to a control signal received from the controller.

11. A fuel injection device for engines according to claim 10, wherein the actual injection characteristic is a maximum injection rate, the target injection characteristic is an actual target maximum injection rate, the basic target control amount is a basic target command pulse output timing for the flow control valve, and the final target control amount is a final target command pulse output timing for the flow control valve which was obtained by correcting the basic target command pulse output timing according to the actual maximum injection rate and the target maximum injection rate.

12. A fuel injection device for engines according to claim 9, wherein the injectors have solenoid valves, each of which controls the opening and closing of the nozzle holes according to a control signal received from the controller.

13. A fuel injection device for engines according to claim 12, wherein the actual injection characteristic is an actual injection start timing, the target injection characteristic is a target injection start timing, the basic target control amount is a basic target command pulse output timing for each of the solenoid valves, and the final target control amount is a final target command pulse output timing for each of the solenoid valves which was obtained by correcting the basic target command pulse output timing according to the actual injection start timing and the target injection start timing.

14. A fuel injection device for engines according to claim 12, wherein the actual injection characteristic is an actual gross injection amount, the target injection characteristic is a target gross injection amount, the basic target control amount is a basic target gross command pulse width for each of the solenoid valves, and the final target control amount is a final target gross command pulse width for each of the solenoid valves which was obtained by correcting the basic target gross command pulse width according to the actual gross injection amount and the target gross injection amount.

15. A fuel injection device for engines according to claim 12, wherein the actual injection characteristic is an actual initial injection amount, the target injection characteristic is a target initial injection amount, the basic target control amount is a basic target initial command pulse width for each of the solenoid valves, and the final target control amount is a final target initial command pulse width which was obtained by correcting the basic target actual initial command pulse width according to the initial injection amount and the target initial injection amount.

16. A fuel injection device for engines according to claim 12, wherein the engine has cylinders provided with the injectors, and the correction of the basic target control amount is performed according to the injection characteristic of each of the injectors in the cylinders that was determined at the previous fuel injection.

17. A fuel injection device for engines according to claim 12, wherein the detection signals from the sensors are converted into digital signals before being supplied to the controller via a high-speed computation device.

18. A fuel injection method for a engine having a common rail which stores fuel delivered by a fuel pump, and injectors which are respectively supplied with the fuel from the common rail, comprising:

(a) detecting engine operating states by sensors, (b) setting a target injection characteristic by a controller based on the detected engine operating state, (c) setting a basic target control amount based on the target injection characteristic, (d) detecting an actual injection characteristic based on a changing ate over time of fuel pressure in the common rail following fuel injection from an individual injector of the engine, (e) setting a final target control amount which is obtained by correcting the basic target control amount based on both the target injection characteristic and the actual injection characteristic, and (f) executing fuel injection from the injector based on the final target control amount, a fuel injection method for engines wherein the actual injection characteristic includes at least an actual maximum injection rate determined according to a maximum value of the changing rate of the fuel pressure, an actual injection start timing determined as a time when the changing rate of the fuel pressure exceeds a predetermined value, and an actual gross injection amount determined according to an integrated value obtained by integrating the changing rate of the fuel pressure over a fuel injection period or an actual initial injection amount determined according to an integrated value obtained by integrating the changing rate of the fuel pressure over an initial injection period; wherein the target injection characteristic includes at least a target maximum injection rate of the fuel, a target injection start timing, and a target gross.

* * * * *